US009933739B2

(12) United States Patent
Hirano

(10) Patent No.: US 9,933,739 B2
(45) Date of Patent: Apr. 3, 2018

(54) DRUM UNIT, IMAGE FORMING UNIT AND IMAGE FORMING APPARATUS

(71) Applicant: Oki Data Corporation, Tokyo (JP)

(72) Inventor: Masato Hirano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/598,390

(22) Filed: May 18, 2017

(65) Prior Publication Data

US 2017/0343945 A1 Nov. 30, 2017

(30) Foreign Application Priority Data

May 31, 2016 (JP) ..... 2016-108469

(51) Int. Cl.
*G03G 15/00* (2006.01)

(52) U.S. Cl.
CPC ..... *G03G 15/5033* (2013.01); *G03G 15/751* (2013.01)

(58) Field of Classification Search
CPC ..... G03G 15/5033; G03G 15/751; G03G 2215/00957
USPC ..... 399/159
See application file for complete search history.

(56) References Cited

U.S. PATENT DOCUMENTS 9,482,970 B2 * 11/2016 Nauka ..... G03G 5/147
2004/0126683 A1 * 7/2004 Jin ..... C08F 230/08 430/58.2
2006/0029874 A1 * 2/2006 Kanazawa ..... G03G 5/00 430/72
2008/0124637 A1 * 5/2008 Uematsu ..... G03G 5/00 430/56
2008/0145781 A1 * 6/2008 Tong ..... G03G 5/0535 430/270.1
2014/0322638 A1 * 10/2014 Zhou ..... G03G 5/047 430/66
2017/0090312 A1 * 3/2017 Hirakata ..... G03G 5/0542

FOREIGN PATENT DOCUMENTS

JP 2006-030704 A 2/2006

* cited by examiner

*Primary Examiner* — Robert Beatty
(74) *Attorney, Agent, or Firm* — Muncy, Geissler, Olds & Lowe, P.C.

(57) ABSTRACT

A drum unit includes a photosensitive drum and a cleaning member. A scratch remaining depth measured by a scratch test of the photosensitive drum under a following Test Condition 1 is 110 nm or less. Test Condition 1 is; test environment temperature=25° C.; test environment humidity=50%; test indenter=pre-mount type Berkovich indenter; scratch direction=horizontal direction; scratch speed=20 μm/sec; initial load=0 mN; maximum reaching load=4 mN; and load at the time of measuring the scratch remaining depth=1.9 mN.

10 Claims, 7 Drawing Sheets

*Fig. 18 (PRIOR ART)*

Measured Scratch Remaining Depth [nm]

| Type of Printer | Hardness HM [Mpa] | Scratch Remaining Depth [nm] | Scratch Remaining Depth [nm] | | Filming Occupancy Ratio | |
|---|---|---|---|---|---|---|
| | | | (Sheet No.) | Evaluation | (%) | Evaluation |
| MC1035PS | 211 | 112.3 | 18800 | C | 6.0 | C |
| B731 | 133 | 166.9 | 55400 | A | 13.9 | C |
| B432dn | 158 | 150.2 | 32200 | A | 11.6 | C |
| C332dn | 156 | 131.3 | 32000 | A | 11.8 | C |

DRUM UNIT, IMAGE FORMING UNIT AND IMAGE FORMING APPARATUS

CROSS REFERENCE TO RELATED APPLICATIONS

This application claims priority under 35 USC 119 to Japanese Patent Application No. 2016-108469 filed on May 31, 2016 original document, the entire contents which are incorporated herein by reference.

TECHNICAL FIELD

The present invention relates to a drum device having a photosensitive drum, and a developing device and an image forming apparatus using the drum device.

BACKGROUND

An image forming apparatus of an electrophotographic system is widely spread. Compared with an image forming apparatus of other systems such as an inkjet system, a high-quality image can be obtained in a short time.

The image forming apparatus of the electrophotographic system is equipped with a photosensitive drum and forms an image on a surface of a medium such as a paper using the photosensitive drum. In the image forming process, after an electrostatic latent image is formed on the surface of the photosensitive drum, a developer is adhered to the electrostatic latent image. The developer adhered to this electrostatic latent image is fused after being transferred to the medium.

Since the structure of a photosensitive drum affects the quality, etc., of an image formed using an image forming apparatus, various considerations have been made regarding the structure of the photosensitive drum.

Specifically, in order to prevent the occurrence of image defects due to the occurrence of toner filming or the like, the surface protective layer of the photosensitive drum contains a hardened material of cyanate ester (for example, see Patent Document 1).

RELATED ART

[Patent Doc. 1] JP Laid-Open Application Publication 2006-030704

Various considerations have been made relating to the structure of a photosensitive drum, but the quality of images, etc., is not satisfactory yet, so there is room for improvement.

The present invention has been made in view of the aforementioned problems, and aims to provide a drum device, a developing device, and an image forming apparatus capable of stably obtaining a high-quality image.

SUMMARY

A drum unit disclosed in the application includes a photosensitive drum and a cleaning member that is arranged to contact to a surface of the photosensitive drum. Wherein a scratch remaining depth measured by a scratch test of the photosensitive drum under a following Test Condition 1 is 110 nm or less.

Test Condition 1 is:

test environment temperature=25° C.;

test environment humidity=50%;

test indenter=pre-mount type Berkovich indenter;

scratch direction=horizontal direction;

scratch speed=20 μm/sec;

initial load=0 mN;

maximum reaching load=4 mN; and load at the time of measuring the scratch remaining depth=1.9 mN.

An image forming unit disclosed in the application includes the drum unit discussed above, and a developer carrier that is arranged to face the photosensitive drum.

An image forming apparatus disclosed in the application includes the image forming unit discussed above, an exposure unit that exposes the photosensitive drum; and a transfer part that is arranged to face the photosensitive drum.

The aforementioned scratch test is carried out with respect to the outer circumferential surface (the surface on which the electrostatic latent image is formed) of a photosensitive drum, that is, the top layer (photoreceptive layer) of the photosensitive drum. In the later described push-in test, the testing is similarly performed with respect to a photoreceptive layer in this way.

According to the drum device, the developing device, and the image forming apparatus of an embodiment of the present invention, since the scratch remaining depth is 110 nm or less, it is possible to stably obtain a high-quality image.

BRIEF DESCRIPTION OF THE DRAWINGS

FIG. 18 shows test results of conventional photosensitive drums under Test Condition 1 (PRIOR ART).

DETAILED DESCRIPTION OF THE PREFERRED EMBODIMENTS

Hereinafter, an embodiment according to the present invention will be explained in detail with reference to the drawings. The order of description is as follows:

1. Developing device (including the drum device)
   1-1. Overall structure
   1-2. Detailed structure of the photosensitive drum
   1-3. Detailed structure of the cleaning blade
   1-4. Physical properties of the photosensitive drum
   1-5. Physical properties of the cleaning blade
   1-6. Mode of use
   1-7. Operation
   1-8. Functions and effects
2. Image forming apparatus
   2-1. Structure
   2-2. Operation
   2-3. Functions and effects
3. Modified example

1. Developing Device (Including Drum Device)

First, a developing device according to an embodiment of the present invention will be explained.

The developing device described herein is used, for example, for a full color printer, etc., of an electrophotographic system, to perform, for example, a development process, that is, processing to adhere developer to the electrostatic latent image. However, the usage of the developing device is not limited to the above-described full color printer of an electrophotographic system.

Since the drum device according to one embodiment of the present invention constitutes a part of the developing device described herein, the drum device will be described below together.

<1-1. Overall Structure>

Figure 1:
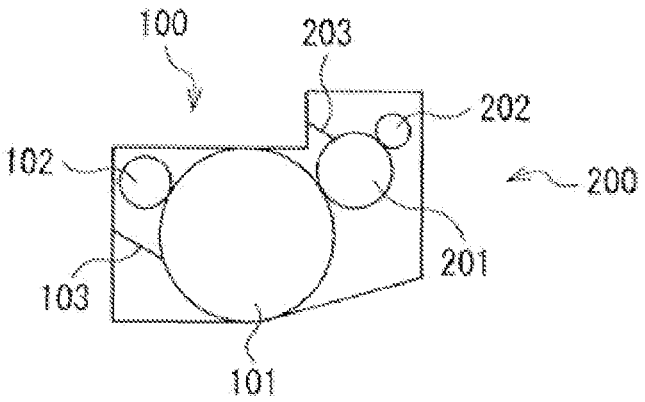
FIG. 1 is a plan view showing a configuration of a developing device according to one embodiment of the present invention.

FIG. 1 is a planar configuration of the developing device.

As shown in FIG. 1, for example, the developing device includes a drum part 100 and a development process part 200 for performing a development process using the drum part 100.

[Drum Part]

The drum part 100 is a drum device according to an embodiment of the present invention, and includes, for example, a photosensitive drum 101.

The photosensitive drum 101 is mainly used to form an electrostatic latent image. For example, this photosensitive drum 101 is a rotation body (organic-system photoreceptor) extending in a direction intersecting with the plane of paper of FIG. 1, and rotatable centering a rotation shaft extending in that direction. The detailed configuration of the photosensitive drum 101 will be described later (see FIGS. 2 and 3).

However, the drum part 100 may include any one type or two or more types of other constituent elements together with the above-described photosensitive drum 101. The type of the other constituent element is not especially limited, but is, for example, a charge roller 102 and a cleaning blade 103.

The charge roller 102 mainly charges the surface of the photosensitive drum 101 in order to make it possible to form an electrostatic latent image on the surface of the photosensitive drum 101. This charge roller 102 is, for example, a rotation body extending in the same direction as the extending direction of the photosensitive drum 101, and is rotatable like the photosensitive drum 10.

Specifically, the charge roller 102 includes, for example, a metal shaft and a semiconductive epichlorohydrin rubber layer covering the outer circumferential surface of the metal shaft. The charge roller 102 is press-contacted to the photosensitive drum 101 in order to charge the surface of the photosensitive drum 101.

The cleaning blade 103 is a plate-shaped member mainly for scraping unnecessary developers, etc., remaining on the surface of the photosensitive drum 101, and extends in the same direction as the extending direction of the photosensitive drum 101. The cleaning blade 103 is press-contacted to the photosensitive drum 101 in order to scrape the aforementioned unnecessary developers, etc. The detailed configuration of the cleaning blade 103 will be described later (see FIG. 4). The cleaning blade is one example of a cleaning member that functions to clean the surface of the photosensitive drum (or function to eliminate remaining toner on the surface photosensitive drum).

[Development Process Part]

The development process part 200 includes, for example, a development roller 201.

The development roller 201 is a developing body that mainly carries a developer and adheres the developer to the electrostatic latent image formed on the surface of the photosensitive drum 101. The development roller 201 is, for example, a rotation body extending in the same direction as the extending direction of the photosensitive drum 101, and is rotatable in the same manner as the photosensitive drum 101. Specifically, the development roller 201 includes, for example, a metal shaft and a semiconductive urethane rubber layer covering the outer circumferential surface of the metal shaft.

However, the development process part 200 may include any one type or two or more types of other constituent elements together with the aforementioned development roller 201. The type of the other constituent elements is not especially limited, but is, for example, the supply roller 202, the development blade 203, etc.

The supply roller 202 mainly supplies the developer to the surface of the development roller 201. The supply roller 202 is, for example, a rotation body extending in the same direction as the extending direction of the photosensitive drum 101, and is rotatable in the same manner as the photosensitive drum 101. Specifically, the supply roller 202 includes, for example, a metal shaft and a semiconductive foamed silicon sponge layer covering the outer circumferential surface of the metal shaft. The supply roller 202 is press-contacted to the development roller 201 in order to supply the developer to the surface of the development roller 201.

The development blade 203 mainly controls the thickness of the developer supplied to the surface of development roller 201. For example, the development blade 203 extends in the same direction as the extending direction of the photosensitive drum 101 and is disposed at a position separated from the development roller 201 by a predetermined interval. Based on the interval between the development roller 201 and the development blade 203, the thickness of the developer is controlled. Further, the development blade 203 contains, for example, one type or two or more types of metallic materials such as stainless steel, etc.

<1-2. Detailed Structure of Photosensitive Drum>

Figure 2:
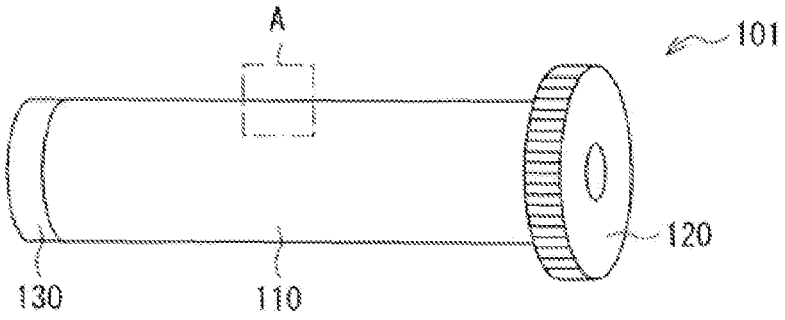
FIG. 2 is a perspective view showing the configuration of a photosensitive drum.
Figure 3:
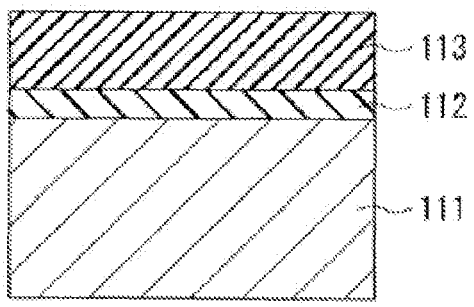
FIG. 3 is a cross-sectional view showing a configuration of a part of a photosensitive drum.

FIG. 2 shows a perspective configuration of the photosensitive drum 101, and FIG. 3 shows a cross-sectional configuration of a part of the photosensitive drum 101. However, in FIG. 3, the cross-section of the portion A shown in FIG. 2 is enlarged.

The photosensitive drum 101, as shown in FIG. 2, for example, includes a drum main body 110, a drum gear 120 attached to one end part of the drum main body 110, and a drum flange 130 attached to the other end part of the drum main body 110.

[Drum Main Body]

The drum main body 110 is, for example, a cylindrical conductive supporting body. As shown in FIG. 3, for example, the drum main body 110 includes a cylindrical supporting body 111, an undercoat layer 112 covering the outer circumferential surface of the supporting body 111, and a photoreceptive layer 113 covering the surface of the undercoat layer 112.

[Supporting Body]

The supporting body 111 is, for example, a metal pipe containing one type or two or more types of metal materials such as aluminum.

[Undercoat Layer]

The undercoat layer 112 mainly improves the adhesive property and blocking property, etc., of the photoreceptive layer 113. The undercoat layer 112 includes, for example, any one type or two or more types of polymer compounds. The undercoat layer 112 may be a single layer or a multi-layer.

The polymer compound is, for example, an epoxy resin, a polyethylene resin, a polypropylene resin, an acrylic resin, methacrylic resin, a polyamide resin, a vinyl chloride resin, a vinyl acetate resin, a phenol resin, a polycarbonate resin, a polyurethane resin, a polyimide resin, a vinylidene chloride resin, a polyvinyl acetal resin, a vinyl chloride-vinyl acetate copolymer, a polyvinyl alcohol resin, a polyurethane resin, a polyacrylic acid resin, a polyacrylamide resin, a polyvinyl pyrrolidone resin, a polyvinyl pyridine resin, a water-soluble polyester resin, a cellulose ester resin (e.g., nitrocellulose, etc.), a cellulose ether resin, casein, gelatin, polyglutamic acid, starch, starch acetate, amino starch, a zirconium chelate compound, an organozirconium compound (e.g., dizirconium alkoxide, etc.), a titanyl chelate compound, an organic titanyl compound (for example, a titanyl alkoxide, etc.), silane coupling agent, etc. These polymer compound may be subjected to a curing reaction using a curing agent.

Among them, it is preferable that the polymer compound be an alcohol-soluble copolymer polyamide or a modified polyamide. This is because it is easy to form the undercoat layer 112 using a coating method since excellent solubility and dispersibility can be obtained.

However, the undercoat layer 112 may contain any one type or two or more types of other constituent elements together with the aforementioned polymer compound. The type of the other constituent elements is not especially limited, but it is, for example, plural particles, etc.

A plurality of particles is retained by the polymer compound, for example, by being dispersed in the polymer compound. Specifically, each of the plurality of particles includes one type or two or more types of metal oxides, etc. For example, the metal oxide may include only one type of metal element as a constituent element, and may include two or more types of metal elements as constituent elements.

A metal oxide containing only one type of a metal element as a constituent element is, for example, titanium oxide, aluminum oxide, silicon oxide, zirconium oxide, zinc oxide, iron oxide, etc. A metal oxide containing two or more metal elements as the constituent elements is, for example, calcium titanate, magnesium titanate, barium titanate, etc.

Among them, it is preferable that the metal oxide be titanium oxide, aluminum oxide or the like, and more preferably titanium oxide. This is because the dielectric constant is high and the dispersibility is excellent. The surface of the titanium oxide may be covered with, for example, any one type or two or more types of inorganic oxide, organic oxide, etc. The inorganic oxide is, for example, tin oxide, aluminum oxide, antimony oxide, zirconium oxide, silicon oxide, etc. The organic oxide is, for example, stearic acid, polyol, silicone, etc.

The undercoat layer 112 is formed by applying a solution in which a polymer compound or the like is dissolved or dispersed by a solvent such as an organic solvent, for example, to the outer circumferential surface of the supporting body 111, and then drying the solution. The type of this solvent is, for example, similar to the type of the solvent used for forming the photoreceptive layer 113 described later.

[Photoreceptive Layer]

The photoreceptive layer 113 has, for example, a single-layer structure or a multi-layer structure.

Specifically, the photoreceptive layer 113 having a single-layer structure includes, for example, one type or two or more types of charge generation materials and one type or two or more types of charge transportation materials. That is, the photoreceptive layer 113 having a single-layer structure is the charge generation layer and charge transportation layer.

The thickness of the photoreceptive layer 113 having a single-layer structure is not especially limited but is, for example, 5 μm to 100 μm, preferably 5 μm to 50 μm, and more preferably 5 μm to 10 μm.

However, the photoreceptive layer 113 having a single-layer structure may include one type or two more types of other materials together with the aforementioned charge generation material and charge transportation material. The type of the other materials is not especially limited but is, for example, a polymer compound which disperses and holds a charge generation material, charge transportation material, etc.

The charge generation material includes, for example, one type or two or more types of charge generation substances. This charge generation substance may be used alone or may be used in a state of being mixed with one type or two or more types of dying pigments. The type of the charge generation substance is not particularly limited, but is, for example, an inorganic photo-conductive material and an organic photo-conductive material. The inorganic photo-conductive material is, for example, selenium, selenium alloy, cadmium sulfide, etc. The organic photo-conductive material is, for example, an organic pigment, etc. The organic pigment is, for example, a phthalocyanine pigment, an azo pigment, a dithioketopyrrolopyrrole pigment, a squalene pigment (squarilium), a quinacridone pigment, an indigo pigment, a perylene pigment, a polycyclic quinone pigment, an anthanthrone pigment, a benzimidazole pigment, etc. Among them, it is preferable that the charge generation substance be an organic photo-conductive material, and more preferably an organic pigment or the like. Further, it is preferable that the charge generation substance used in the mixed state is a phthalocyanine pigment, an azo pigment, etc., from the viewpoint of light sensitivity, etc. When an organic pigment is used as a charge generation substance, generally, for example, a dispersion layer including a polymer compound (various binder resins) is used together with fine particles of an organic pigment. In this dispersion layer, fine particles of the organic pigment are bound via a binder resin. The thickness of the dispersion layer is not especially limited, but is, for example, 0.1 μm to 10 μm, preferably 0.15 μm to 0.6 μm.

The charge transportation material includes, for example, one type or two or more types of charge transportation substances. The type of the charge transportation substance is not especially limited, but examples include an aromatic amine derivative, a stilbene derivative, a butadiene derivative, a hydrazone derivative, a carbazole derivative, an aniline derivative, an enamine derivative, etc. Besides this, the charge transportation substance may be, for example, a compound in which any one type or two or more types of the aforementioned aromatic amine derivatives are combined. Further, the charge transportation substance may be a polymer (electron donating material) having, for example, a group composed of the aforementioned aromatic amine derivative as a main chain or a side chain. Among them, it is preferable that the charge transportation substance be a compound in which an aromatic amine derivative, a stilbene derivative, a hydrazone derivative, an enamine derivative and any one type or two or more types of them are combined, and it is more preferable that the compound be a compound in which the aromatic amine derivative and an enamine derivative are combined.

The polymer compound is, for example, a polyvinyl acetal resin, a polyarylate resin, a polycarbonate resin, a polyester resin, a modified etheric polyester resin, a phenoxy resin, a polyvinyl chloride resin, a polyvinylidene chloride resin, a polyvinyl acetate resin, a polystyrene resin, an acrylic resin, a methacrylic resin, a polyacrylamide resin, a polyamide resin, a polyvinyl pyridine resin, a cellulose resin, a polyurethane resin, an epoxy resin, a silicone resin, a polyvinyl alcohol resin, a polyvinyl pyrrolidone resin, casein, a vinyl chloride-vinyl acetate copolymer, a styrene-butadiene copolymer, a styrene-butadiene copolymer, a vinylidene chloride-acrylonitrile copolymer, a styrene-alkyd resin, a silicone-alkyd resin, a phenol-formaldehyde resins, an organic photoconductive resins, etc. The vinyl chloride-vinyl acetate copolymer is, for example, vinyl chloride-vinyl acetate copolymers, hydroxy-modified vinyl chloride-vinyl acetate copolymers, carboxyl-modified vinyl chloride-vinyl acetate copolymers and vinyl chloride-vinyl acetate-maleic anhydride copolymer and the like. The organic photoconductive resin is, for example, a poly-N-vinylcarbazole, polyvinylanthracene, polyvinylperylene and the like.

The photoreceptive layer 113 having a single-layer structure is, for example, formed by using a coating method. In this case, for example, a solution in which a charge generation material and a charge transportation material, etc., are dissolved or dispersed with a solvent such as an organic solvent, is applied to the surface of the undercoat layer 112, and then the solution is dried.

The type of the solvent is not especially limited, but examples include a saturated aliphatic solvent, an aromatic solvent, a halogenated aromatic solvent, an amide solvent, an alcohol solvent, an aliphatic polyhydric alcohol, a ketone solvent, an ester solvent, a halogenated hydrocarbon solvent, an ether solvent, an aprotic polar solvent, a nitrogen containing compound, mineral oil, water, etc.

The saturated aliphatic solvent is, for example, pentane, hexane, octane, nonane, etc. The aromatic solvent is, for example, toluene, xylene, anisole, etc. The halogenated aromatic solvent is, for example, chlorobenzene, dichlorobenzene, chloronaphthalen, etc. The amide-based solvent is, for example, dimethylformamide, N-methyl-2-pyrrolidone, etc. The alcohol-based solvent is, for example, methanol, ethanol, isopropanol, n-butanol, benzyl alcohol, etc. The aliphatic polyhydric alcohol is, for example, glycerin, polyethylene glycol, etc. The ketone-based solvent is, for example, acetone, cyclohexanone, methyl ethyl ketone, 4-methoxy-4-methyl-2-pentanone, etc. The ester type solvent is, for example, methyl formate, ethyl acetate, n-butyl acetate, etc. The halogenated hydrocarbon solvent is, for example, methylene chloride, chloroform, 1,2-dichloroethane, etc. The ether type solvent is, for example, diethyl ether, dimethoxyethane, tetrahydrofuran, 1,4-dioxane, methyl cellosolve, and ethyl cellosolve. The aprotic polar solvent is, for example, acetonitrile, dimethylsulfoxide, sulfolane, and hexamethylphosphoric triamide. The nitrogen-containing compound is, for example, n-butylamine, isopropanolamine, diethylamine, triethanolamine, ethylenediamine, triethylenediamine, and triethylamine. The mineral oil is, for example, ligroin and the like.

The type of coating method used to form the photoreceptive layer 113 is not especially limited as long as it is any one type or two or more types of arbitrary coating methods. Specifically, the coating method may be, for example, a dip coating method, a spray coating method, a spinner coating method, a bead coating method, a wire bar coating method, a blade coating method, a roller coating method, an air knife coating method, a curtain coating method, etc.

The drying conditions after the application are not especially limited. As a drying method, for example, after touch drying at a normal temperature (25° C.), it is heated and dried at 30° C. to 200° C. The drying time is, for example, 1 minute to 2 hours. When drying, it may be windless or hot-air blow. In the case of heating and drying, the heating temperature may be fixed or the heating temperature may be changed.

On the other hand, the photoreceptive layer 113 having a multi-layer structure includes, for example, a charge generation layer and a charge transportation layer formed on the charge generation layer. That is, in the photoreceptive layer 113 having a multi-layer structure, the charge generation layer is arranged on the side close to the undercoat layer 112 and the charge transportation layer is arranged on the side far from the undercoat layer 112. The charge generation layer includes any one type or two or more types of charge generation materials and the charge transportation layer contains any one type or two or more types of charge transportation materials. The details relating to each of the charge generation material and the charge transportation material are, for example the same as those described for the photoreceptive layer 113 having a single-layer structure.

The thickness of the charge generation layer is not particularly limited, but is, for example, 0.1 μm to 10 μm. The thickness of the charge transportation layer is not especially limited, but is, for example, 5 μm to 50 μm. The thickness (total thickness) of the photoreceptive layer 113 having the multi-layer structure is not especially limited, but is, for example, 5 μm to 50 μm, preferably 10 μm to 45 μm, and more preferably 10 μm to 30 μm.

However, the charge generation layer may include any one type or two or more types of other materials together with the charge generation material described above. In addition, the charge transportation layer may include one type or two or more types of other materials together with the charge transportation material described above. The type of the other material is not especially limited, but is, for example, a polymer compound which disperses and holds a charge generation material or a charge transportation material or the like. The details relating to the polymer compound are, for example, the same as those described for the photoreceptive layer 113 having a single-layer structure.

The photoreceptive layer 113 having a multi-layer structure is, for example, formed by using a coating method. In this case, for example, a solution in which a charge generation material or the like is dissolved or dispersed by a solvent such as an organic solvent is applied to the surface of the undercoat layer 112, and then the solution is dried to form a charge generation layer. After that, for example, after applying a solution in which a charge transportation material or the like is dissolved or dispersed by a solvent such as an organic solvent to the surface of the charge generation layer, and then drying the solution, a charge transportation layer is formed. The details of the type of solvent, the type of coating method, the drying condition after the application, etc., are, for example, the same as those described for the method of forming the photoreceptive layer 113 having a single-layer structure.

<1-3. Detailed Structure of Cleaning Blade>

Figure 4:
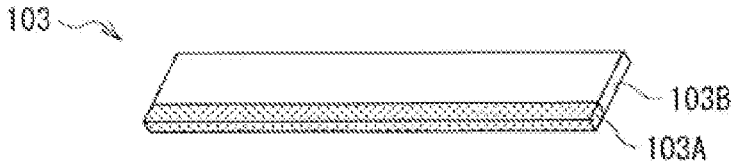
FIG. 4 is a perspective view showing the configuration of a cleaning blade.

FIG. 4 shows a perspective configuration of the cleaning blade 103. In FIG. 4, the state of the cleaning blade 103 viewed from the same direction as the direction in which the photosensitive drum 101 is viewed in FIG. 3 is shown.

The cleaning blade 103 as shown in FIG. 4, for example, includes a front end (press-contacted) portion 103A to be press-contacted to the photosensitive drum 101 and a support portion 103B supporting the tip end portion 103A.

[Tip End Portion]

The tip end portion 103A includes any one type or two or more types of polymer compounds such as polyurethane. The polyurethane may be, for example, manufactured by using any one type or two or more types of polyols, any one type or two or more types of isocyanates, any one type or two or more types of curing agents.

The type of the polyol is not especially limited, and examples include polyethylene adipate, polybutylene adipate, polyethylene butylene adipate, etc.

The type of isocyanate is not especially limited, and examples include tolylene diisocyanate, 4,4-diphenylmethane diisocyanate, hexamethylene isocyanate, 1,4-cyclohexane diisocyanate, the isomers thereof, etc.

The type of the curing agent is not especially limited, but is, for example, a mixture of high moelcular weight polyol, low molecular weight diol, and low molecular weight triol. The type of the polymer polyol is not especially limited, but is, for example, polyethylene adipate (weight average molecular weight=2,000). The type of the low molecular weight diol is not especially limited, but examples include 1,4-butanediol, ethylene glycol, diethylene glycol, 1,6-hexanediol, and neopentyl glycol. The type of the low molecular weight triol is not especially limited, but is, for example, trimethylolpropane and triisopropanolamine.

The method of manufacturing the tip end portion 103A in the case of using polyurethane as the polymer compound is, for example, as follows. first, after mixing the polyol and isocyanate subjected to a dewatering process, the mixture is reacted (reaction temperature=70° C. to 140° C., reaction time=10 minutes to 120 minutes) to obtain a prepolymer. Subsequently, after mixing the prepolymer and the curing agent, the mixture is injected into a mold of a centrifugal molding machine (preheating temperature=150□). Subsequently, the mixture is subjected to a curing reaction (reaction time=25 minutes to 50 minutes) to obtain a hardened material (polyurethane). Finally, after removing the hardened material from the mold, the hardened material is cut into a strip-like shape and the tip end portion 103A is completed.

Although the state of the tip end portion 103A is not especially limited, it is preferable that the peak temperature of tan δ (1 Hz) be 10° C. or higher. This is because the polymer compound becomes a glass state on a temperature side lower than the peak temperature of tan δ and the polymer compound becomes a rubber state on the higher temperature side than the peak temperature of tan δ. By using a polymer compound in a rubber state as the forming material of the tip end portion 103A, the tip end portion 103A is more likely to follow the photosensitive drum 101, so it becomes easier for the cleaning blade 103 to scrape unnecessary developers.

[Support Portion]

The support portion 103B contains, for example, any one type or two or more types of metal materials such as electrogalvanized steel sheet (SECC).

<1-4. Physical Properties of Photosensitive Drum>

In the developing device, in order to optimize the deformation characteristics of the surface vicinity portion of the photosensitive drum 101, the photosensitive drum 10 has specific physical properties.

[First Condition]

Specifically, the physical properties of the photosensitive drum 10 satisfy the first condition described below. That is, when a scratch test of the photosensitive drum 101 is performed under the following <Test Condition 1>, the scratch remaining depth measured by the scratch test is 110 nm or less.

<Test Condition 1>

Test environment temperature=25° C., test environment humidity=50%, test indenter=pre-mount type Berkovich indenter, scratch direction=horizontal direction, scratch speed=20 μm/sec, initial load=0 mN, maximum reaching load=4 mN, load at the time of measuring scratch remaining depth=1.9 mN As described above, the scratch test on the photosensitive drum 101 described herein is performed with respect to the top layer (photoreceptive layer 113) of the photosensitive drum 101. Therefore, when the photoreceptive layer 113 has a single-layer structure, since the charge generation layer and charge transportation layer is shaved off in the scratch test, the scratch remaining depth is measured with respect to the charge generation layer and charge transportation layer. On the other hand, when the photoreceptive layer 113 has a multi-layer structure, since the charge transportation layer is shaved off in the scratch test, the scratch remaining depth is measured with respect to the charge transportation layer.

The reason why the physical properties of the photosensitive drum 101 satisfy the first condition is mainly because the deformation characteristics of the surface of the photosensitive drum 101 and the vicinity thereof are optimized from the viewpoint of the restorative force at the time of deformation of the photosensitive drum 101. As a result, even if foreign bodies adhere to the surface of the photosensitive drum 101 due to the occurrence of toner filming, the foreign bodies become more likely to be scraped off with the cleaning blade 103, and therefore spots become less likely to occur in the image. The details of the reason why the physical properties of this photosensitive drum 101 satisfy the first condition will be described later (see FIGS. 15 and 16).

[Scratch Test]

Figure 5:
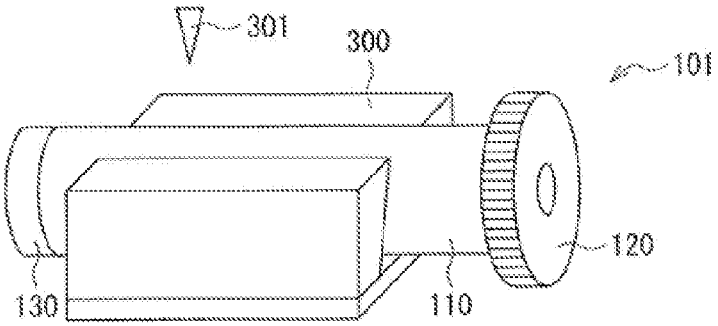
FIG. 5 is a perspective view explaining the procedure of a scratch test.

The details of the above-described scratch test are, for example, as follows. FIG. 5 illustrates a perspective configuration corresponding to FIG. 2 for explaining the procedure of the scratch test.

When the scratch test is performed, first, for example, as shown in FIG. 5, in the test environment: temperature=25° C.; and humidity=50%, the photosensitive drum 101 is fixed using a holder 300 and an indenter 301 is arranged so as to face the photosensitive drum 101 (photoreceptive layer 113).

The holder 300 is a jig for holding (fixing) the photosensitive drum 101 by pinching it, and is movable (along the extending direction of photosensitive drum 101) horizontally while holding the photosensitive drum 101. As the indenter 301, a pre-mount type Berkovich indenter (facing angle=145°) is used. The material of this pre-mount type Berkovich indenter is, for example, diamond.

Subsequently, the holder 300 is moved in the horizontal direction while pressing the indenter 301 against the photosensitive drum 101.

In this case, the moving speed (scratch speed) of the holder 300 is set to 20 μm/sec, and the force (load) for pressing the indenter 301 against the photosensitive drum 101 is gradually increased from 0 mN (initial load) to 4 mN (maximum reach load). In addition, for example, the allowable heat transfer rate is set to 1 nm/sec and the moving distance (scratch distance) of the holder 300 is set to 400 μm. The speed (mN/sec) at which the load is increased from the initial load to the maximum reach load may be arbitrary set as long as the load can reach the maximum reach load from the initial load while the indenter 301 is pressed against the photosensitive drum 101.

Finally, at the time when the load has reached 1.9 mN, after detaching the indenter 301 from the photosensitive drum 101, the depth (scratch remaining depth) of the dent formed in the photosensitive drum 101 at the place where the indenter 301 was pressed is measured.

In order to measure the scratch remaining depth by performing this scratch test, for example, a micro-hardness tester can be used. This micro-hardness tester is, for example, a micro-hardness tester named "Nano Indenre G200" manufactured by Aglient Technologies. By using a micro altimeter, the scratch remaining depth can be measured automatically.

Figure 6:
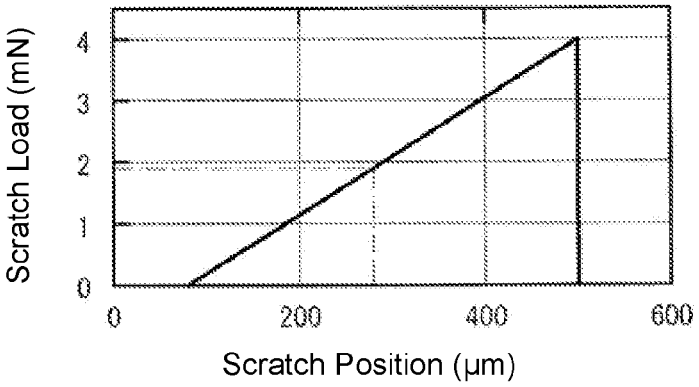
FIG. 6 is a graph explaining the setting procedure of the load in the scratch test.
Figure 7:
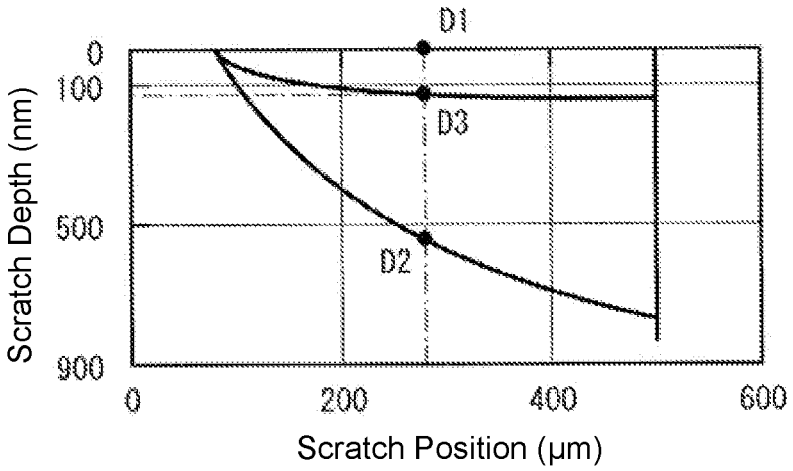
FIG. 7 is a graph showing the test result of the scratch test.

When a micro-hardness tester is used, for example, the scratch remaining depth can be measured by the following procedures. FIG. 6 is a graph for explaining the load setting procedure in the scratch test, and FIG. 7 is a graph showing the test result (scratch depth profile) of the scratch test.

In the case of performing a scratch test using the micro-hardness tester, first, for example, as shown in FIG. 6, a load to be applied to the indenter 301 is set. In FIG. 6, the horizontal axis indicates the position (scratch position: μm) on the surface of the photosensitive drum 101, and the vertical axis indicates the load (mN) applied to the indenter 301.

In FIG. 6, for example, in the case where the indenter 301 moves from the scratch position=0 μm to the scratch position=500 μm on the surface of the photosensitive drum 101, the case in which the load becomes maximum (=4 mN) at the scratch position=500 μm is shown. As is apparent from FIG. 6, the scratch depth gradually increases as the scratch position increases.

In FIG. 6, the scratch load is larger than 0 mN after the scratch position=approximately 90 μm or more. This means that, for example, as the result that the indenter 301 gradually approaches the photosensitive drum 101 while the photosensitive drum 101 moves in the horizontal direction, the indenter 301 contacts the photosensitive drum 101 at the scratch position=about 90 μm.

Further, in FIG. 6, the scratch load decreases from 4 mN to 0 mN at the scratch position=500 μm. This means that, for example, the load gradually decreases as the indenter 301 is gradually moved away from the photosensitive drum 101 at that position.

In FIG. 6, it illustrates the case in which the scratch load reaches the state (scratch load=1.9 mN) to measure the scratch remaining depth at the scratch position=about 280 μm.

Subsequently, by performing the scratch test using the micro-hardness tester, as shown in FIG. 7, the profile of the scratch remaining depth is obtained. In FIG. 7, the horizontal axis indicates the scratch position (μm) and the vertical axis indicates the scratch depth (nm).

In FIG. 7, for example, as described above, since the indenter 301 comes into contact with the photosensitive drum 101 at the scratch position=about 90 μm, the scratch depth gradually increases at the scratch position=about 90 μm and thereafter.

In the scratch test using the micro-hardness tester, first, when the indenter 301 comes into contact with the photosensitive drum 101, the reference depth (scratch depth D1=0 μm) for measuring the scratch depth is measured (identified) . The load at the time of measuring this scratch depth D1 is, for example, 0.03 mN.

Subsequently, by scratching the photosensitive drum 101 (photoreceptive layer 113) using the indenter 301, the depth (scratch depth D2) of the dent formed on the surface of the photosensitive drum 101 by the indenter 301 is measured. This scratch depth D2 is the depth of the dent measured in a state in which the photosensitive drum 101 and the indenter 301 are in contact.

Subsequently, at the place where the scratch depth D2 was measured, by moving the indenter 301 away from the photosensitive drum 101 until the scratch load=0.03 mN, the depth (scratch depth D3) of the dent immediately after the detachment of the indenter 301 is measured.

In this case, when the indenter 301 is moved away from the photosensitive drum 101 in order to measure the scratch depth D3 after measuring the scratch depth D2, the photosensitive drum 101 is restored due to the removal of the external force caused by the indenter 301. With this, the depth of the dent is reduced, and therefore the scratch depth D3 becomes smaller than the scratch depth D2.

Subsequently, by repeating the above-mentioned measuring procedure of the scratch depths D2 and D3 while moving the photosensitive drum 101 in the horizontal direction and gradually increasing the load applied to the indenter 301, the scratch depth profile shown in FIG. 7 is completed.

In FIG. 7, for example, as described with reference to FIG. 6, at the scratch position=about 280 μm, the scratch load has reached the state (scratch load=1.9 mN) to measure the scratch remaining depth.

Finally, based on the profile of the scratch depth, the scratch depth D3 (scratch remaining depth) at the time when the scratch load has reached 1.9 mN is specified. With this, the scratch remaining depth can be measured.

The reason that the scratch load for measuring the scratch remaining depth is set to 1.9 mN is as follows.

As will be described later, when a foreign body adheres to the surface of the photosensitive drum 101 due to the occurrence of toner filming, at the time of scraping the foreign body using the cleaning blade 103, scratches are generated on the cleaning blade 103 (tip end portion 103A). The particle diameter of this foreign body is, for example, 100 μm or less. In the cases where a scratching occurs on the cleaning blade 103, the cleaning blade 103 receives a load not one-dimensionally (point state) but two-dimensionally (line state) due to the presence of a foreign body.

Therefore, based on the linear pressure of the cleaning blade 103, the load that the cleaning blade 103 receives one-dimensionally is estimated. Assuming that the linear pressure of the cleaning blade 103 is 19 gf/cm and the particle diameter of the foreign body is 100 μm, the load received by the cleaning blade 103 is calculated to be 1.9 mN according to the calculation expressed by the following formula (1). Since this load (=1.9 mN) is the load generated at the contact point between the cleaning blade 103 and the foreign body, it is considered that a similar load is generated also at the contact point between the photosensitive drum 101 and the foreign body.

$$\text{Load}=19\ \text{gf/cm}\times 100\ \mu\text{m}\times 10^{-4}\ \text{cm}\times 9.8\ \text{mN/gf}=1.88\ \text{mN}\approx 1.9\ \text{mN} \quad (1)$$

In other words, it is considered that the state in which a load of 1.9 mN is applied to the photosensitive drum 101 is a state in which the load applied to the photosensitive drum 101 becomes the maximum due to the presence of the foreign body. Therefore, in order to optimize the deformation characteristics of the surface portion of the photosensitive drum 101 and the vicinity thereof, in other words, in order to prescribe the first condition, the scratch load at the time of measuring the scratch remaining depth is set to 1.9 mN.

[Scratch Remaining Depth Adjustment Method]

In order to adjust the scratch remaining depth, for example, it is sufficient to change the type and composition of the polymer compound contained in the photoreceptive layer 113.

[Second Condition]

When the physical properties of the photosensitive drum 101 satisfy the above-described first condition, it is further preferable that the following second condition be satisfied. Specifically, when a push-in test of the photosensitive drum 101 is performed in the following <Test Condition 2>, the Martens hardness measured by the push-in test is 100 $N/mm^2$ to 170 $N/mm^2$.

<Test Condition 2>

Temperature of the test environment=25° C., humidity of the test environment=50%, indenter for testing=pre-mount type Berkovich indenter, maximum load=4 mN, load duration=30 seconds, peak load retention time=25 seconds, unload duration=30 seconds The push-in test regarding the photosensitive drum 101 described herein is carried out with respect to the top layer (photoreceptive layer 113) of the photosensitive drum 101 in the same manner as in the scratch test regarding the above-described photosensitive drum 101. That is, when the photoreceptive layer 113 has a single-layer structure, the Martens hardness is measured for the charge generation layer and charge transportation layer, and when the photoreceptive layer 113 has a multi-layer structure, the Martens hardness is measured for the charge transportation layer.

The reason why the physical properties of the photosensitive drum 101 satisfy the second condition is mainly because the deformation characteristics of the surface of the photosensitive drum 101 and the vicinity thereof are optimized from the viewpoint of the wear resistance of the photosensitive drum 101. With this, the charging failure of the photosensitive drum 101 is suppressed, so that print smear becomes less likely to occur in the image.

In detail, when the developing device is repeatedly used, due to the contact between the photosensitive drum 101 and the development roller 201, etc., the photosensitive drum 101 is continuously rubbed by the development roller 201, etc. This causes abrasion of the photosensitive drum 101 (photoreceptive layer 113), resulting in decrease of the photoreceptive layer 113. In this case, if the thickness of the photoreceptive layer 113 excessively decreases, the photoreceptive layer 113 becomes difficult to retain electric charges given from the charge roller 102. As a result, the electrical potential of the electrostatic latent image is lowered, and therefore it becomes difficult for the developer to adhere to the electrostatic latent image. With this, on the surface of the photosensitive drum 101, the developer becomes likely to unintentionally adhere up to the region where the electrostatic latent image is not formed, so that print smear can occur in the image.

When the Martens hardness is larger than 170 $N/mm^2$, since the photoreceptive layer 113 is too hard, the photoreceptive layer 113 becomes difficult to elastically deform. Therefore, since the photoreceptive layer 113 becomes easier to wear, print smear becomes likely to occur.

On the other hand, when the Martens hardness is 170 $N/mm^2$ or less, since the photoreceptive layer 113 is moderately soft, the photoreceptive layer 113 becomes likely to deform elastically. Therefore, since the photoreceptive layer 113 becomes less likely to wear, print smear becomes less likely to occur.

However, when the Martens hardness is less than 100 $N/mm^2$, it is necessary to use a high molecular weight polymer compound as the forming material (polymer compound) of the photoreceptive layer 113 when forming the photoreceptive layer 113. Therefore, when forming the photoreceptive layer 113 using a coating method, the viscosity of the solution in which the polymer compound is dissolved or dispersed becomes high. Therefore, it becomes difficult to uniformly form (deposit) the photoreceptive layer 113 using a coating method, so there is a possibility that it may become fundamentally difficult to form the photoreceptive layer 113 before considering the print smear.

Therefore, in order to suppress the occurrence of print smear while easily and stably forming the photoreceptive layer 113, the Martens hardness is preferably 100 $N/mm^2$ to 170 $N/mm^2$.

[Push-in Test]

The details concerning the above-described push-in test are, for example, as follows.

When the push-in test is performed, first, for example, as shown in FIG. 5, in the test environment: temperature=25° C.; and humidity=50%, the photosensitive drum 101 is fixed using a holder 300 and an indenter 301 is arranged so as to face the photosensitive drum 101. The details regarding this indenter 301 are, for example, the same as those described for the scratch test.

Subsequently, after pressing the indenter 301 against the photosensitive drum 101, while moving the indenter 301 away from the photosensitive drum 101, the depth (push-in depth) of the dent formed in the photosensitive drum 101 at the place where the indenter 301 is pressed is measured.

In this case, the force (push-in load) for pressing the indenter 301 against the photosensitive drum 101 is increased to 4 mN (maximum load). However, the time (load duration) required for the load to reach the maximum load is set to 30 seconds and the time (unloading duration) required to unload the load is set to 30 seconds. Also, the peak load retention time is set to 25 seconds.

Finally, after obtaining the push-in load (maximum push-in load) when the push-in depth becomes maximum, based on the calculation formula expressed by the following formula (2), the Martens hardness ($N/mm^2$) is calculated.

$$\text{Martens hardness}\ (N/mm^2)=\text{Push-in load (N) when the push-in depth becomes maximum}/\text{Surface area}\ (mm^2)\ \text{of the indenter 301 under the push-in load when the push-in depth becomes maximum} \quad (2)$$

In order to measure the Martens hardness by performing this push-in test, for example, a micro-hardness tester may be used in the same manner as in the scratch test. The model of this micro-hardness tester is, for example, the same as the model used to perform the scratch test. By using the micro-hardness tester, it is possible to automatically measure the push-in load (maximum push-in load) when the push-in depth becomes maximum, so as described above, using the formula (2), the Martens hardness can be calculated.

Figure 8:
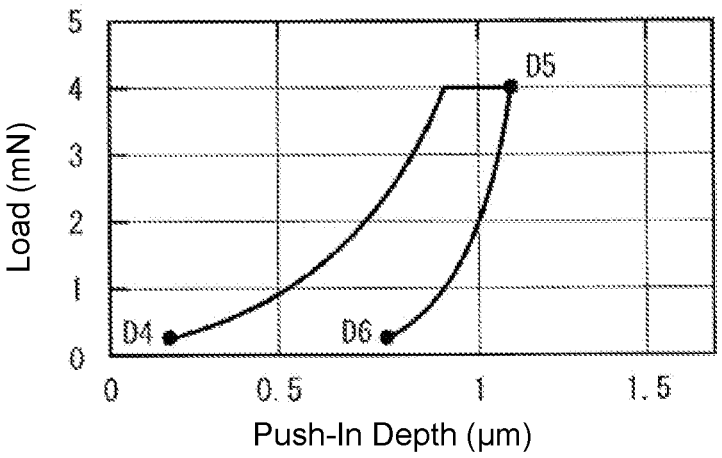
FIG. 8 is a graph showing the test result of the push-in test.

FIG. 8 is a graph showing the test result (push-in depth profile) of the push-in test. In FIG. 8, the horizontal axis indicates the push-in depth (μm) and the vertical axis indicates the load (mN).

As clearly shown in FIG. 8, when the indenter 301 is pressed against the photosensitive drum 101 and then is moved away from the photosensitive drum 101, the push-in depth changes according to the load. Specifically, when the load is increased and then decreased, the push-in depth increases from the push-in depth D4 to the push-in depth D5 and then decreases to the push-in depth D6. Although, the photosensitive drum 101 is about to be restored at the place where the indenter 301 is pressed, even if the indenter 301 is detached, since the photosensitive drum 101 cannot be restored to the initial state (the state before the indenter 301 is pressed), the push-in depth D6 becomes larger than the push-in depth D5.

In order to obtain the Martens hardness, the maximum value of the push-in depth (push-in depth D5) is obtained based on the profile of the push-in depth and then the load corresponding to the push-in depth D5 is obtained. In FIG. 8, for example, the case in which the load at the time when the push-in depth became maximum is about 6.5 mN is shown. Therefore, it is possible to calculate the Martens hardness based on the calculation formula shown in the above-described formula (1).

[Adjustment Method of Martens Hardness]

The method of adjusting the Martens hardness is not particularly limited.

Specifically, in order to adjust the Martens hardness, for example, it is sufficient to change the viscosity average molecular weight of the forming material (polymer compound) of the photoreceptive layer 113. That is, when the viscosity average molecular weight of the polymer compound is increased, the Martens hardness is increased, while when the viscosity average molecular weight of the polymer compound is decreased, the Martens hardness is decreased. In the case of forming the photoreceptive layer 113 using a coating method, for example, at the time of preparing the solution in which the polymer compound is dissolved or dispersed, the viscosity average molecular weight of the polymer compound can be adjusted.

Here, for example, when a polyarylate resin is used as a polymer compound, the Martens hardness can be controlled to be 100 N/mm$^2$ to 170 N/mm$^2$ by setting the viscosity average molecular weight to 10,000 to 300,000, preferably 20,000 to 100,000. Conversely speaking, when the viscosity average molecular weight is decreased so as to be less than 10,000, the Martens hardness will become lower than 100 N/mm$^2$, and when the viscosity average molecular weight is increased to be larger than 100,000, the Martens hardness will exceed 170 N/mm$^2$.

When the viscosity average molecular weight is smaller than 10,000, not only the Martens hardness becomes lower than 100 N/mm$^2$ but also the physical strength of the photoreceptive layer 113 may decrease. Also, when the viscosity average molecular weight is larger than 100,000, the Martens hardness tends to become higher than 170 N/mm$^2$, and that there is a possibility that it becomes difficult to form the photoreceptive layer 113 so as to obtain a desired thickness using a coating method.

The type of polyarylate resin is not particularly limited, but is represented by, for example, the following formula (1). The polyarylate resin shown in the formula (1) is produced using, for example, a bivalent hydroxyaryl component and a dicarboxylic acid component.

[Formula 1]

(1)

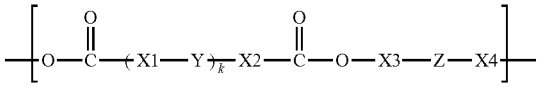

(Each of X1 to X4 is an arylene group or an arylene group having substituent. Y is any one of oxygen atom (—O—), sulfur atom (—S—), —CR1R2- and —O—R3—-O—. Z is any one of an oxygen atom, a sulfur atom and —CR4R5-. k is any one of integers from 0 to 5. Each of R1 and R2 is any one of a hydrogen atom (H—), an alkyl group, and an aryl group, and R1 and R2 may be combined with each other to form a ring. R3 is either an alkylene group or an arylene group and —R6-X5-R7-. Each of R6 and R7 is an alkylene group, and X5 is an arylene group. Each of R4 and R5 is any one of a hydrogen atom, an alkyl group, an alkoxy group and aryl group, and R4 and R5 may be combined with each other to form a ring. However, each of Y and Z may be omitted. When k=0, one of X3 and X4 is an arylene group having substituents.)

The type of substituent is not particularly limited. The type of arylene group is not particularly limited, but, for example, a phenylene group may be exemplified. The type of alkyl group is not particularly limited, but, for example, a methyl group, an ethyl group, and a propyl group may be exemplified. The type of aryl group is not particularly limited, but, for example, a phenylene group may be exemplified. The type of alkylene group is not particularly limited, but, for example, a methylene group, an ethylene group, and a propylene group may be exemplified. The type of alkoxy group is not particularly limited, but, for example, a methoxy group and an ethoxy group may be exemplified. When there is no Y, X1 and X2 are combined with each other, and when there is no Z, X3 and X4 are combined with each other.

Further, in order to adjust the Martens hardness, for example, it is enough to add an additive satisfying a specific condition to the photoreceptive layer 113. This additive is, for example, a low molecular weight compound having a weight average molecular weight of 500 or less. By containing a low molecular weight compound in the photoreceptive layer 113, it is possible to change the Martens hardness without significantly affecting the electrical characteristics and the elastic deformation ratio. The weight average molecular weight of the low molecular weight compound is not particularly limited as long as it is 500 or less, but it is preferably 400 or less, more preferably 300 or less, and even more preferably 250 or less. As the weight average molecular weight of the low molecular weight compound decreases, the compatibility of the low molecular weight compound with respect to the polymer compound in the photoreceptive layer 113 improves, so the Martens hardness increases.

The type of low molecular weight compound is not particularly limited, but is represented by, for example, the following formula (2).

[Formula 2]

$$R11\text{-}(\text{-}W\text{-})_n R12 \quad (2)$$

(Each of R11 and R12 is any one of an alkyl group, an alkyl group having a substituent, an aryl group, an aryl group having a substituent, an aralkyl group, an aralkyl group having a substituent, an acyl group, an acyl group with a substituent, a cycloalkyl group having a cycloalkyl group and a substituent. W is a heteroatom other than a nitrogen atom. "n" is any one of integers from 1 to 8.)

Details regarding each of the alkyl group, the aryl group, and the substituent are the same as, for example, those described for the polyarylate resin shown in the formula (1). The aralkyl group is, for example, a benzyl group. The acyl group is, for example, an acetyl group. The cycloalkylgroup is, for example, a cyclohexyl group. The heteroatom is, for example, an oxygen atom (O) and a sulfur atom (S).

The number of carbon atoms of each of the alkyl group and an alkyl group having a substituent is not particularly limited, but is, for example, 6 to 30. The number of carbon atoms of each of the aryl group and an aryl group having a substituent is not particularly limited, but is, for example, 6 to 30. The number of carbon atoms of each of the aralkyl group and an aralkyl group having a substituent is not particularly limited, but is, for example, 6 to 30. The number of carbon atoms of each of the acyl group and an acyl group having a substituent is not particularly limited, but is, for example, 6 to 30. The number of carbon atoms of each of the cycloalkyl group and an cycloalkyl group having a substituent is not particularly limited, but is, for example, 3 to 12.

<1-5. Physical Properties of Cleaning Blade>

When the physical properties of the photosensitive drum 101 satisfy the above-described first condition, it is further preferable that the cleaning blade 103 have specific physical properties.

[Third Condition]

Specifically, the physical properties of the cleaning blade 103 preferably satisfy the third conditions described below. That is, when the push-in test of the tip end portion 103A is performed under the <Test Condition 3> described below, the surface Young's modulus measured by the push-in test is 18 MPa to 30 MPa, and that the plastic deformation amount measured by the push-in test under the same conditions is 1 N·mm to 4 N·mm.

<Test Condition 3>

Test environment temperature=25° C., test environment humidity=50%, test indenter=pre-mount type Berkovich indenter, maximum load=5 mN, load duration=30 seconds, peak load retention time=25 seconds, unloading duration=30 seconds The reason that the physical properties of the cleaning blade 103 satisfy the third condition is that the deformation characteristics and wear characteristics, etc., of the tip end portion 103A are mainly optimized in relation to the physical properties (first condition) of the above-described photosensitive drum 101. As a result, even if a foreign body adheres to the surface of the photosensitive drum 101 due to the occurrence of toner filming, the cleaning blade 103 becomes easier to scrape the foreign body, and therefore spots are less likely to occur in the image.

Specifically, when using the developing device, since the cleaning blade 103 contacts the photosensitive drum 101, a Stick-Slip phenomenon occurs at the tip end portion 103A. This Stick-Slip phenomenon is a self-excited vibration phenomenon induced due to the repeat of the microscopic friction surface adherence and slippage on the contact surface (friction surface) between the photosensitive drum 101 and the tip end portion 103A. When the stick-slip phenomenon occurs, even if a foreign body adheres to the surface of the photosensitive drum 101 due to the occurrence of toner filming, spot tends to occur in the image because the cleaning blade 103 becomes harder to scrape the foreign body.

In cases where the physical properties of the cleaning blade 103 do not satisfy the third condition, the surface Young's modulus of the tip end portion 103A is not proper, and therefore the tip end portion 103A does not become hard enough. In this case, when Stick-Slip phenomenon occurs, the moving distance of the tip end portion 103A due to the vibrational motion increases, so that the cleaning blade 103 becomes hard to scrape the foreign body. Therefore, when toner filming occurs, the foreign body becomes likely to remain on the surface of the photosensitive drum 101, so that spots may occur.

Moreover, since the plastic deformation amount of the tip end portion 103A is inappropriate, when the Stick-Slip phenomenon occurs, the tip end portion 103A becomes likely to wear due to the contact (friction) with the photosensitive drum 101. Therefore, when using the developing device repeatedly, the cleaning blade 103 becomes more difficult to scrape the foreign body, so spots become more likely to occur continuously.

Particularly, if the tip end portion 103A is easy to wear, depending on the case, since there is a possibility that the tip end portion 103A is partially damaged, there is a possibility that spots may occur in a wide range in the image.

In cases where the physical properties of the cleaning blade 103 satisfy the third condition, the surface Young's modulus of the tip end portion 103A is proper, and therefore the tip end portion 103A becomes hard enough. In this case, even if the Stick-Slip phenomenon occurs, the moving distance of the tip end portion 103A due to the vibrational motion decreases, so that the cleaning blade 103 becomes easy to scrape the foreign body. Therefore, even if toner filming occurs, the foreign body becomes hard to remain on the surface of the photosensitive drum 101, so that spots becomes less likely to occur.

Moreover, since the plastic deformation amount of the tip end portion 103A is appropriate, even if the Stick-Slip phenomenon occurs, the tip end portion 103A becomes less likely to wear due to the contact with the photosensitive drum 101. Therefore, even when using the developing device repeatedly, the cleaning blade 103 becomes likely to scrape the foreign body, so spots become less likely to occur continuously. In this case, the possibility that the tip end portion 103A is partially damaged also decreases, so that spots becomes less likely to occur in a wide range in the image.

Especially, in cases where the physical properties of the cleaning blade 103 satisfy the third condition, the surface Young's modulus of the tip end portion 103A is not excessive, and therefore the elasticity of the tip end portion 103A can be secured. Therefore, the possibility that the tip end portion 103A is partially damaged is significantly reduced, and therefore the phenomenon that the developer passes through the cleaning blade 103 due to the partial damage of the tip end portion 103A becomes less likely to occur.

Moreover, since the plastic deformation amount of the tip end portion 103A is not excessive, the elasticity of the tip end portion 103A is ensured as well. Therefore, when the tip end portion 103A is pulled due to the rotation of the photosensitive drum 101, the tip end portion 103A properly deforms using the elasticity, which suppresses that the tip end portion 103A is damaged so as to be torn off. Further, since the plastic deformation amount of the tip end portion 103A is not too small, cracks are less likely to occur in the tip end portion 103A due to the collision of a foreign body, and the tip end portion 103A is less likely to be partially damaged. Therefore, due to the partial damage of the tip end portion 103A, the phenomenon that a developer passes through the cleaning blade 103 becomes less likely to occur.

In the developing device, in cases where the physical properties of the photosensitive drum 101 satisfy the first condition, the physical properties of the cleaning blade 103 may satisfy the third condition, in cases where the physical properties of the photosensitive drum 101 satisfy the first and second conditions, the physical properties of the cleaning blade 103 may satisfy the third condition. However, in order to obtain a higher-quality image, the latter is preferable than the former.

[Push-in Test]

The details regarding the push-in test are the same as those described with respect to the physical properties (second condition) of the photosensitive drum 101 except that, for example, measurement items and test conditions are different. In order to measure the surface Young's modulus and the plastic deformation amount by performing the push-in test, for example, in the same manner as in the case described on the physical properties (second condition) of the photosensitive drum 101, it is enough to use a micro-hardness tester. The type (model) of this micro-hardness tester is, for example, as described above.

[Adjustment Method of Surface Young's Modulus and Plastic Deformation Amount]

The method of adjusting each of the surface Young's modulus and the plastic deformation amount is not particularly limited.

Specifically, in order to adjust each of the surface Young's modulus and the plastic deformation amount, for example, the type and composition of the forming material (polymer compound) of the tip end portion 103A may be changed. Specifically, in cases where polyurethane is used as the forming material of the tip end portion 103A, for example, each type of high moelcular weight polyol, low molecular weight diol and low molecular weight triol contained in the curing agent is changed, and the mixing ratio of those mixtures may be changed.

<1-6. Mode of Use>

Figure 9:
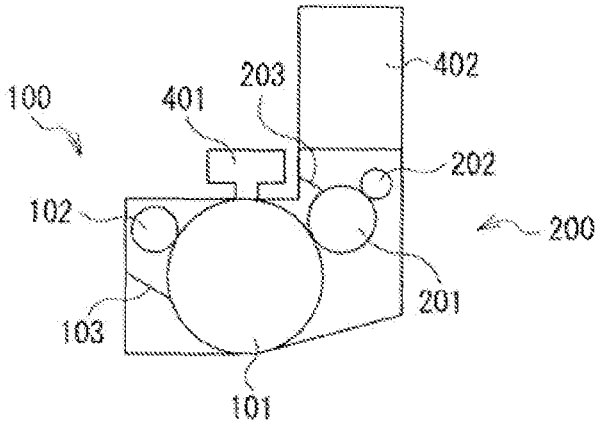
FIG. 9 is a plan view for explaining the mode of use of the developing device shown in FIG. 1.

FIG. 9 illustrates a plane configuration corresponding to FIG. 1 for explaining an example of a mode of use of the developing device.

The developing device described here is used, for example, in the manner shown in FIG. 9. In this developing device, for example, a light emitting diode (LED) head 401 and a cartridge 402 are removably installed.

The LED head 401 is an exposure device which forms an electrostatic latent image on the surface of the photosensitive drum 101 by exposing, mainly, the surface of the photosensitive drum 101. This LED head 401 is removably installed with respect to, for example, a drum part 100, and includes an LED element, a lens array, etc. The LED element and the lens array, etc., are arranged so that, for example, the light (irradiated light) output from the LED element forms an image on the surface of the photosensitive drum 101.

The cartridge 402 contains a developer, and is removably attached to, for example, the development process part 200. The type (color) of developer contained in the cartridge 402 is determined, for example, according to the combination of colors required for forming an image.

As examples, the types of developer used to form a full color image are as follows. The cartridge 402 used to form a yellow image contains a yellow developer. The cartridge 402 used to form a magenta image contains a magenta developer. The cartridge 402 used to form a cyan image contains a cyan developer. The cartridge 402 used to form a black image contains a black developer. That is, in order to form a full-color image, for example, four types of (four colors) developers are used.

The details concerning the developer are, for example, as follows. However, the developer described here is, for example, a developer of a single component development system, and more specifically, for example, a developer of a negative charge.

The single component development system is a system in which an appropriate charge amount is given to the developer itself without using a carrier (magnetic particle) to give an electric charge to the developer. On the other hand, the two component development system is a system in which the carrier and a developer are mixed so that an appropriate charge amount is given to the developer using the friction between the carrier and the developer.

The developer is made of, for example, a plurality of particles, and the developer includes, for example, a coloring agent. This coloring agent is mainly used for coloring an image.

The yellow developer contains, for example, as a coloring agent, one or more of a yellow pigment and a yellow dye (pigment). The yellow pigment is, for example, a pigment yellow 74, etc. The yellow dye is, for example, a C.I. pigment yellow 74, a cadmium yellow, etc.

The magenta developer contains, for example, as coloring agent, one or more of a magenta pigment and a magenta dye (pigment). The pigment of magenta is, for example, quinacridone. The magenta dye is, for example, C.I. pigment red 238, etc.

The cyan developer contains, for example, as a coloring agent, one or more of a cyan pigment and a cyan dye (pigment). The cyan pigment is, for example, a phthalocyanine blue (C.I. pigment blue 15:3), etc. The cyan dye is, for example, a pigment blue 15:3, etc.

The black developer contains, for example, as a coloring agent, one or more of a black pigment and a black dye (pigment). The black pigment is, for example, carbon. The black dye is, for example, carbon black, and the carbon black is, for example, furnace black, channel black, etc.

However, in addition to the above-mentioned coloring agent, the developer may include any one or more types of other materials. The type of the other material is not particularly limited, but may be, for example, a binding agent, a release agent, a charge control agent, an external additive, etc.

The binding agent primarily binds a coloring agent, etc. The binding agent includes one or more types of polymer compounds, such as, e.g., a polyester resin, a styrene-acrylic resin, an epoxy resin, and a styrene-butadiene resin.

Among them, the binding agent preferably contains a polyester resin. This is because the developer containing polyester a resin as a binding agent becomes easy to fuse to the medium since the polyester resin has high affinity to a medium such as paper. This is also because the polyester resin has high physical strength even when the molecular weight is relatively small, and therefore the developer including a polyester resin has excellent durability as a binding agent.

This polyester resin is, for example, a reactant (condensation polymer) of one or more alcohols and one or more carboxylic acids.

The type of alcohol is not particularly limited, but among other things, it is preferable that it be a dihydric or higher alcohol and its derivative, etc. The dihydric or higher alcohol is, for example, ethylene glycol, diethylene glycol, triethylene glycol, polyethylene glycol, propylene glycol, butanediol, pentanediol, hexanediol, cyclohexanedimethanol, xylene glycol, dipropylene glycol, polypropylene glycol, bisphenol A, hydrogenated bisphenol A, bisphenol A ethylene oxide, bisphenol A propylene oxide, sorbitol, glycerin, etc.

The type of carboxylic acid is not particularly limited, but among other things it is preferable that it be a carboxylic acid having two or more valences and a derivative thereof. The dicarboxylic or higher carboxylic acid is, for example, maleic acid, fumaric acid, phthalic acid, isophthalic acid, terephthalic acid, succinic acid, adipic acid, trimellitic acid, pyromellitic acid, cyclopentanedicarboxylic acid, succinic anhydride, trimellitic anhydride, maleic anhydride, dodecenyl succinic anhydride, etc.

The release agent mainly improves developer's fusability, offset resistance, etc. The release agent includes any one or more types of waxes, such as, e.g., an aliphatic hydrocarbon wax, an oxide of an aliphatic hydrocarbon wax, a fatty acid ester wax, and a deoxidized product of a fatty acid ester wax. Besides this, the release agent may be, for example, a block copolymer of a series of waxes as described above.

Examples of the aliphatic hydrocarbon wax include, for example, low molecular weight polyethylene, low molecular weight polypropylene, a copolymer of olefin, a microcrystalline wax, paraffin wax, and a Fischer Tropsch wax. The oxide of the aliphatic hydrocarbon wax is, for example, an oxidized polyethylene wax. The fatty acid ester wax is, for example, a carnauba wax and a montanic acid ester wax. The deoxidized product of the fatty acid ester wax is a wax in which some or all of the fatty acid ester wax is deoxidized, such as deoxidized carnauba wax.

The charge control agent mainly controls the developer's frictional charge, etc. The charge control agent used for a developer of negative charge contains one or more types of, for example, azo type complex, salicylic acid type complex, calixarene type complex, etc.

The external additive improves the flowability of the developer mainly by suppressing agglomeration among the developers. However, the external additive also plays a role to improve, for example, developer's environmental stability, charge stability, developability, storability, and cleaning property.

This external additive is, for example, in the form of a plurality of particles, and is fused to the surface of a mother particle including a coloring agent, etc. Specifically, the external additive includes one or more types of, for example, inorganic materials and organic materials. The inorganic material is, for example, hydrophobic silica. The organic material is, for example, a melamine resin.

The method of manufacturing the developer is not particularly limited. Specifically, the developer may be manufactured using, for example, a pulverization method, may be manufactured using a polymerization method, or may be manufactured using a method other than the methods described above. This polymerization method is, for example, a dissolve suspension method. Of course, the developer may be manufactured using two or more types of the above-described series of manufacturing methods.

<1-7. Operation>

This developing device operates as described below to perform, for example, the development process. Hereinafter, the operation of the developing device, for example, used in the mode of use shown in FIG. 9 will be described.

First, when the photosensitive drum 101 is rotated, the charge roller 102 applies a DC voltage to the surface of the photosensitive drum 101 while rotating. As a result, the surface of the photosensitive drum 101 is uniformly charged.

Subsequently, depending on the image signal, the LED head 401 irradiates light to the surface of the photosensitive drum 101. As a result, the surface potential attenuates (light attenuates) in the light irradiated part on the surface of the photosensitive drum 101, and therefore an electrostatic latent image is formed on the surface of the photosensitive drum 101.

Subsequently, the developer that was contained in the cartridge 402 is supplied to the supply roller 202.

Subsequently, after the voltage is applied to the supply roller 202, the supply roller 202 rotates. With this, the developer is supplied to the surface of the supply roller 202 from the cartridge 402.

Subsequently, after the voltage is applied to the development roller 201, the development roller 201 rotates while being press-contacted to the supply roller 202. With this, the developer supplied to the surface of the supply roller 202 adheres to the surface of the development roller 201, so the developer is carried using the rotation of the development roller 201. In this case, since the development blade 203 removes a part of the developer that is being absorbed by the surface of the development roller 201, the thickness of the developer, which is absorbed by the surface of the development roller 201, is made uniform.

Finally, after the photosensitive drum 101 is rotated while being press-contacted to the development roller 201, the developer that was absorbed by the surface of the development roller 201 is transferred to the surface of the photosensitive drum 101. With this, since the developer adheres to the surface (electrostatic latent image) of the photosensitive drum 101, an image (developer image) is formed by the developer. Thus, the development process is completed.

When the developing device performs the development process, unnecessary developers, etc., may sometimes remain on the surface of the photosensitive drum 101. The unnecessary developers are, for example, a part of developers used in the primary transfer process described below, and are developers, etc., that remain on the surface of the photosensitive drum 101 without being transferred to the intermediate transfer belt 41 described later.

Therefore, the developing device performs the cleaning process using the cleaning blade 103 while performing the development process.

Specifically, since the photosensitive drum 101 is rotated in a state of being press-contacted by the cleaning blade 103, developers remaining on the surface of the photosensitive drum 101 are scraped by the cleaning blade 103. As a result, unnecessary developers, etc., are removed from the surface of the photosensitive drum 101.

<1-8. Functions and Effects>

In this developing device, the physical properties of the photosensitive drum 101 satisfy the above-described first condition. That is, the scratch remaining depth measured by the scratch test of the photosensitive drum 101 in <Test Condition 1> is 110 nm or less. In this case, a high-quality image can be stably obtained by the reasons described below.

Figure 13:
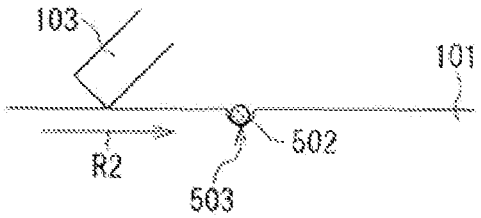
FIG. 13 is a plan view for explaining the operation continuing from FIG. 12.
Figure 14:
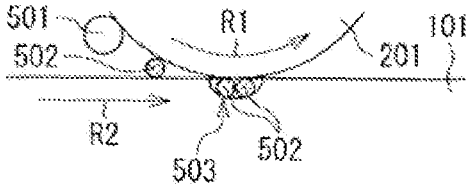
FIG. 14 is a plan view for explaining the operation continuing from FIG. 13.
Figure 15:
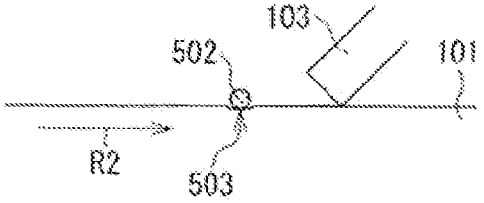
FIG. 15 is a plan view for explaining the advantages relating to the operation of the developing device.
Figure 16:
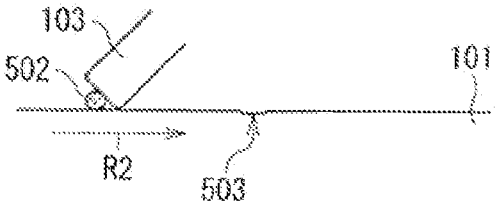
FIG. 16 is a plan view for explaining the operation continuing from FIG. 15.

FIGS. 10 to 14 schematically illustrate the planar configuration of the photosensitive drum 101 and the peripheral part thereof in order to explain the problem related to the operation of the developing device when the physical properties of the photosensitive drum 101 do not satisfy the first condition. FIGS. 15 and 16 illustrate the planar configuration corresponding to FIGS. 10 to 14 in order to explain the advantages regarding to the operation of the developing device when the physical properties of the photosensitive drum 101 satisfy the first condition.

In FIGS. 10 to 16, in order to simplify the illustration, a part of the contour of the development roller 201 is illustrated in a curved manner, whereas a part of the contour of the photosensitive drum 101 is illustrated in a straight manner. The arrow R1 indicates the rotational direction of the development roller 201, and the arrow R2 indicates the rotational direction of the photosensitive drum 101, i.e., the moving direction of the photosensitive drum 101 relative to the development roller 201.

Figure 10:
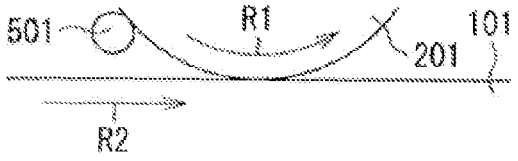
FIG. 10 is a plan view for explaining the problems relating to the operation of the developing device.

When the developing device is used, as shown in FIG. 10, the development roller 201 is press-contacted to the photosensitive drum 101. As a result, the developer 501 carried on the surface of the development roller 201 is supplied to the surface of the photosensitive drum 101.

Figure 11:
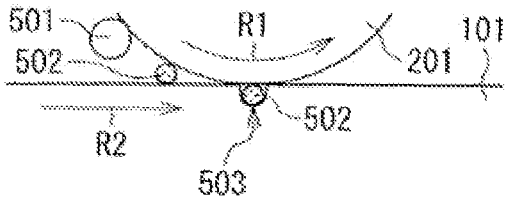
FIG. 11 is a plan view for explaining the operation continuing from FIG. 10.

When using the developing device repeatedly, as shown in FIG. 11, a phenomenon in which the foreign body 502 adheres to the surface of the photosensitive drum 101, that is, toner filming, is likely to occur. This foreign body 502 is a sediment, such as, e.g., fallen matters and fine powder. The fallen matter is, for example, an external additive, a release agent, etc., falling off from the developer 501. The fine powder is, for example, a part of a medium M (see FIG. 17) which will be described later. For example, when the medium M is paper, paper powder or the like is used.

When toner filming occurs, the foreign body 502 adheres to the surface of the photosensitive drum 101 as described above. After that, when a foreign body 502 is carried up to the vicinity of the contact point between the photosensitive drum 101 and the development roller 201 according to the rotation of the photosensitive drum 101, the foreign body 502 is pressed against the photosensitive drum 101 by the development roller 201. As a result, due to the existence of the foreign body 502, the photosensitive drum 101 is deformed so as to be dented at the vicinity of the surface, and therefore a dent 503 is formed on the surface of the photosensitive drum 101.

Figure 12:
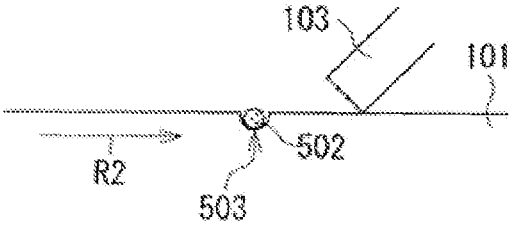
FIG. 12 is a plan view for explaining the operation continuing from FIG. 11.

When the physical properties of the photosensitive drum 101 do not satisfy the first condition, since the restorative force at the time of deformation of the photosensitive drum 101 is not sufficient, when the photosensitive drum 101 is rotated so that the dent 503 moves away from the development roller 201 and approaches the cleaning blade 103 as shown in FIG. 12, the dent 503 is maintained almost as it is. Specifically, when the dent 503 moves away from the contact point (see FIG. 11) between the photosensitive drum 101 and the development roller 201, since the photosensitive drum 101 slightly restores in the vicinity of the dent 503, the depth of the dent 503 slightly decreases. However, since the depth of the dent 503 does not decrease sufficiently to the extent that the foreign body 502 can be scraped using the cleaning blade 103, most of the foreign body 502 remains in the dent 503.

Therefore, as shown in FIG. 13, when the photosensitive drum 101 further rotates, the cleaning blade 103 passes the vicinity of the dent 503 without being able to scrape the foreign body 502 contained inside the dent 503. As a result, the foreign body 502 fuses to the surface of the photosensitive drum 101. In this case, it becomes more difficult for a developer to adhere to an electrostatic latent image in the dent 503 and its vicinity thereof, and therefore spots become likely to occur in the image. This spot becomes a big problem because it becomes actually obvious in the so-called solid image. As a result, it becomes difficult to stably obtain a high-quality image.

In this case, in particular, once the dent 503 is formed, the foreign body 502 is continuously pressed against the photosensitive drum 101 by the development roller 201. Therefore, as shown in FIG. 14, the dent 503 expands and the number of foreign bodies 502 contained in the dent 503 is increased. As a result, the occurrence range of spots in the image is enlarged.

On the other hand, when the physical properties of the photosensitive drum 101 satisfy the first condition, as shown in FIG. 10 and FIG. 11, when the photosensitive drum 101 is rotated after the dent 503 is formed, since the restorative force at the time of deformation is sufficient, as shown in FIG. 15, the deformation of the photosensitive drum 101 is relaxed. That is, since the photosensitive drum 101 is sufficiently restored in the vicinity of the dent 503, the depth of the dent 503 is remarkably reduced. Since the depth of this dent 503 is sufficiently reduced to the extent that the foreign body 502 can be scraped using the cleaning blade 103, most of the foreign body 502 is exposed to the outside of the dent 503.

Therefore, as shown in FIG. 16, when the photosensitive drum 101 further rotates, the foreign body 502 is scraped by the cleaning blade 103. In this case, it becomes for a developer more likely to adhere to an electrostatic latent image also in the dent 503 and its vicinity thereof, and therefore spots become less likely to occur in the image. As a result, a high-quality image can be stably obtained.

Particularly, when the physical properties of the photosensitive drum 101 satisfy the above-described second condition, that is, when the Martens hardness measured by the push-in test of the photosensitive drum 101 in <Test Condition 2> is 100 $N/mm^2$ to 170 $N/mm^2$, as described above, the photosensitive drum 101 becomes less likely to wear, and therefore the charge deficiency of the photosensitive drum 101 is suppressed. In this case, since print smear becomes less likely to occur in the image, a higher-quality image can be stably obtained. Therefore, a higher effect can be obtained.

Further, the physical properties of the cleaning blade 103 satisfy the above-described third condition, that is, the surface Young's modulus measured by the push-in test of the tip end portion 103A in <Test Condition 3> is 18 MPa to 30 MPa and the plastic deformation amount is 1 N·mm to 4 N·mm, as described above, the deformation characteristics and wear characteristics of the tip end portion 103A are optimized. In this case, even if the foreign body 502 adheres to the surface of the photosensitive drum 101 due to the occurrence of toner filming, the cleaning blade 103 becomes easier to scrape the foreign body 502. As a result, spots become less likely to occur in the image, and therefore a higher-quality image can be stably obtained. Therefore, a higher effect can be obtained.

2. Image Forming Apparatus

Next, an image forming apparatus using the above-described developing device will be described.

The image forming apparatus described here is, for example, a full color printer of an electrophotographic system, and forms an image on the surface of a medium M for forming an image. The material of the medium M is not particularly limited, but it is, for example, one type or two or more types of a paper, a film, etc.

<2-1. Structure>

Figure 17:
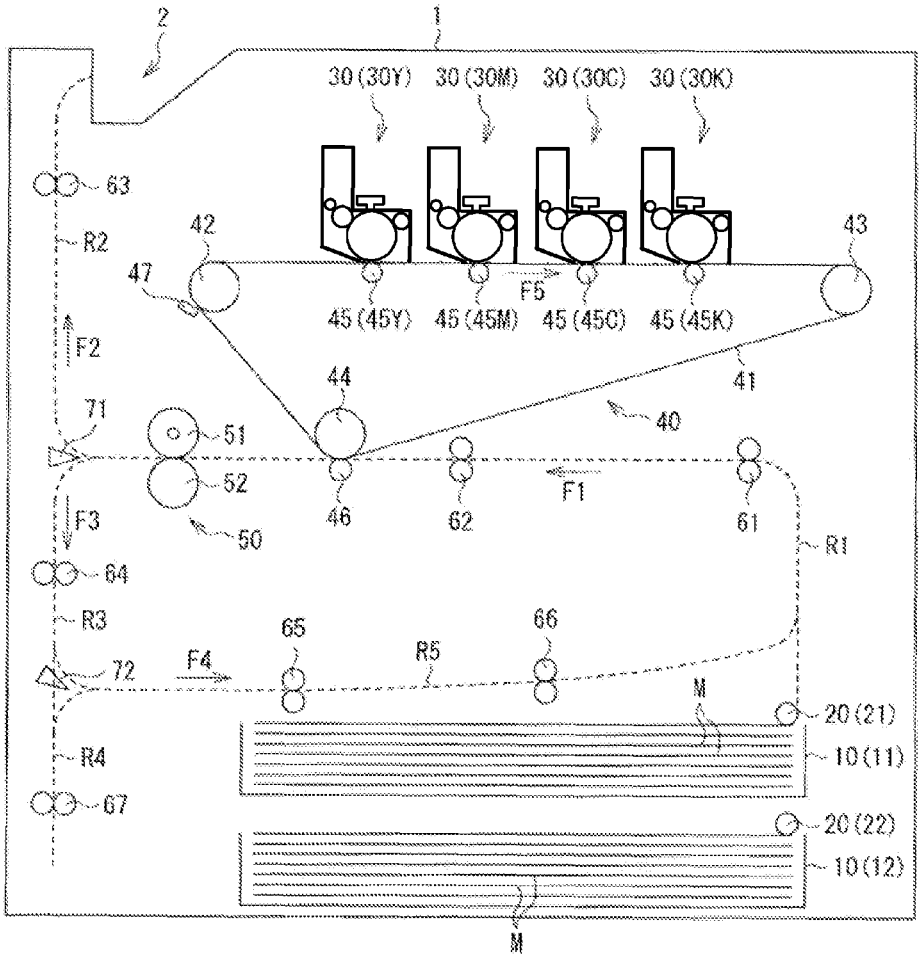
FIG. 17 is a plan view showing the configuration of an image forming apparatus according to one embodiment of the present invention.

FIG. 17 illustrates a planar configuration of an image forming apparatus. For example, as shown in FIG. 17, this image forming apparatus includes, in the housing 1, one or more trays 10, one or more feed rollers 20, one or more developing parts 30, a transfer part 40, a fuser 50, carrying rollers 61 to 67, carrying path switching guides 71 and 72. Other than the above, the image forming apparatus includes one or two or more photosensitive drums corresponding to the photosensitive drum 101 shown in FIGS. 1 and 9.

The housing 1 is provided with a stacker part 2 for ejecting a medium M on which an image is formed, and the medium M is carried along carrying paths R1 to R5.

[Tray and Feed Roller]

The tray 10 contains mediums M, for example, and is removably installed in the housing 1. In this tray 10, for example, a plurality of mediums M are contained in a stacked state, and the plurality of mediums M is taken out one by one from the tray 10 by the feed roller 20.

Here, the image forming apparatus has, for example, two trays 10 (11, 12) and two feed rollers 20 (21, 22). The two trays 11 and 12 are arranged, for example, so as to overlap with each other.

[Developing Part]

The developing part 30 performs a development process using a developer (so-called toner). Specifically, the developing part 30 forms an electrostatic latent image and a developer image (so-called toner image) by making the electrostatic latent image adhere to the developer using a Coulomb force.

Here, the image forming apparatus has, for example, four developing parts 30 (30Y, 30M, 30C, 30K). Accordingly, the image forming apparatus is equipped with, for example, four photosensitive drums.

Each of the developing parts 30Y, 30M, 30C, and 30K is installed, for example, removably with respect to the housing 1, and arranged along the movement path of the intermediate transfer belt 41, which will be described later. Here, the developing parts 30Y, 30M, 30C, and 30K are arranged, for example, in this order from the upstream side to the downstream side in the moving direction of the intermediate transfer belt 41.

Each of the developing parts 30Y, 30M, 30C, and 30K has the same structure as the developing device in which the mode of use is shown in FIG. 9 (except for the developer drum 101) except that, for example, the type of developer contained in the cartridge 402 (see FIG. 9) is different. Further, for example, the photosensitive drum has the same configuration as that of the photosensitive drum 101 shown in FIG. 9.

[Transfer Part]

The transfer part 40 performs a transfer process using a developer developed by the developing part 30. Specifically, the transfer part 40 transfers the developer adhered to the electrostatic latent image by the developing part 30 to the medium M.

The transfer part 40 includes, for example, an intermediate transfer belt 41, a drive roller 42, a driven roller (idler roller) 43, a backup roller 44, one or more primary transfer rollers 45, a secondary transfer roller 46, and a cleaning blade 47.

The intermediate transfer belt 41 is an intermediate transfer medium to which the developer is temporarily transferred before the developer is transferred to the medium M. The intermediate transfer belt 41 is, for example, an endless elastic belt and contains one or more types of polymer compounds such as polyimide. The intermediate transfer belt 41 is movable in accordance with the rotation of the drive roller 42 in a state of being stretched by the drive roller 42, the driven roller 43, and the backup roller 44.

The drive roller 42 is rotatable clockwise through a drive source such as a motor. Each of the driven roller 43 and the backup roller 44 is rotatable clockwise like the drive roller 42, depending on the rotation of the drive roller 42.

The primary transfer roller 45 transfers (primarily transfer) the developer supplied from the developing part 30 to the intermediate transfer belt 41. This primary transfer roller 45 is press-contacted to the developing part 30 (later-described drum 31) via the intermediate transfer belt 41. The primary transfer roller 45 is rotatable clockwise depending on the movement of the intermediate transfer belt 41.

Here, the transfer part 40 includes four primary transfer rollers 45 (45Y, 45M, 45C, 45K) corresponding to, for example, four developing part 30 (30Y, 30M, 30C, 30K). The transfer part 40 includes one secondary transfer roller 46 corresponding to one backup roller 44.

The secondary transfer roller 46 transfers (secondly transfer) the developer transferred to the intermediate transfer belt 41 to the medium M. This secondary transfer roller 46 is press-contacted to the backup roller 44 and includes, for example, a metallic core and an elastic layer such as a foamed rubber layer covering the outer circumferential surface of the core. The secondary transfer roller 46 is rotatable counterclockwise according to the movement of the intermediate transfer belt 41.

The cleaning blade 47 is press-contacted to the intermediate transfer belt 41 to scrape unnecessary developers remaining on the surface of the intermediate transfer belt 41.

[Fuser]

The fuser 50 performs fuse processing using the developer transferred to the medium M by the transfer part 40. Specifically, the fuser 50 fuses the developer to the medium M by pressurizing the developer transferred to the medium M by the transfer part 40 while heating.

The fuser 50 includes, for example, a heat application roller 51 and a pressure application roller 52.

The heat application roller 51 is the rotation body configured to heat the developer image and is rotatable clockwise. The heat application roller 51 includes, for example, a hollow cylindrical metal core and a resin coating formed on the surface of the metal core. The metal core contains a metal material such as, e.g., aluminum. The resin coat includes, for example, a polymer compound such as a copolymer of tetrafluoroethylene and perfluoroalkyl vinyl ether (PFA) and polytetrafluoroethylene (PTFE).

Inside the heat application roller 51 (metal core), for example, a heater such as a halogen lamp is installed. The surface temperature of the heat application roller 51 is detected, for example, by a thermistor disposed at a position distant from the heat application roller 51.

The pressure application roller 52 is a rotation body that pressurizes the developer image and is rotatable counterclockwise while being press-contacted to the heat application roller 51. The pressure application roller 52 is, for example, a metal rod. The metal rod includes, for example, a metal material such as aluminum.

[Carrying Roller]

Each of the carrying rollers 61 to 67 includes a pair of rollers arranged so as to face each other via the carrying paths R1 to R5 of the medium M and carries the medium M taken out by the feed roller 20. Specifically, for example, when an image is formed on only one side of the medium M, the medium M is carried by the carrying rollers 61 to 63 along the carrying paths R1 and R2. For example, when images are formed on both sides of the medium M, the medium M is carried by the carrying rollers 61 to 67 along the carrying paths R1 to R5.

[Carrying Path Switching Guide]

The carrying path switching guides 71 and 72 change the carry direction of the medium M depending on the conditions of the image of a manner to be formed on the medium M (whether an image is formed on only one side of the medium M or an image is formed on both sides of the medium M).

<2-2. Operation>

This image forming apparatus operates as described below, for example, to form an image on the surface of the medium M.

Here, a case in which an image is formed on one side of the medium M will be described with reference to FIGS. 9 and 17. In this case, it is supposed that the medium M contained in the tray 11 is used.

This image forming apparatus performs, for example, development processing, transfer processing, fuse processing, and cleaning processing as described below.

[Development Process]

The medium M contained in the tray 11 is retrieved by the feed roller 21. This medium M is carried along the carrying path R1 by the carrying rollers 61 and 62 in the direction of the arrow F1.

In the development process, the developing part 30Y operates in the same way as the developing device described above. As a result, an electrostatic latent image is formed on the surface of the photosensitive drum 101 and a yellow developer is adhered to the electrostatic latent image, so that a yellow developer image is formed.

[Primary Transfer Process]

In the transfer part 40, when the drive roller 42 is rotated, the driven roller 43 and the backup roller 44 rotate according to the rotation of the drive roller 42. As a result, the intermediate transfer belt 41 moves in the direction of the arrow F5.

In the primary transfer process, a voltage is applied to the primary transfer roller 45Y. Since this primary transfer roller 45Y is press-contacted to the photosensitive drum 101 via the intermediate transfer belt 41, the developer for yellow adhered to the surface (electrostatic latent image) of the photosensitive drum 101 in the above-mentioned development processing is transferred to the intermediate transfer belt 41.

Thereafter, the intermediate transfer belt 41 to which the yellow developer is transferred is subsequently moved in the direction of the arrow F5. As a result, in the developing parts 30M, 30C, and 30K and the primary transfer rollers 45M, 45C, and 45K, the development processing and the primary transfer processing are sequentially performed by the same procedure as the developing part 30Y and the primary transfer roller 45Y described above. Therefore, since the each color developer is sequentially transferred to the intermediate transfer belt 41, a developer image of each color is formed.

That is, since the developing part 30M and the primary transfer roller 45M transfer the magenta developer to the surface of the intermediate transfer belt 41, a magenta developer image is formed. Subsequently, since a cyan developer is transferred to the surface of intermediate transfer belt 41 by the developing part 30C and the primary transfer roller 45C, a cyan developer image is formed. Subsequently, since a black developer is transferred to the surface of intermediate transfer belt 41 by the developing part 30K and the primary transfer roller 45K, a black developer image is formed.

Of course, whether the development processing and the transfer processing are actually carried out in the developing part 30Y, 30M, 30C, and 30K and the primary transfer roller 45Y, 45M, 45C, 45K respectively depends on the color (type of developer and its combination) required to form an image.

[Secondary Transfer Processing]

The medium M carried along the carrying path R1 passes between the backup roller 44 and the secondary transfer roller 46.

In the secondary transfer processing, a voltage is applied to the secondary transfer roller 46. Since the secondary transfer roller 46 is press-contacted to the backup roller 44 via the medium M, the developer transferred to the intermediate transfer belt 41 in the above-described primary transfer processing is transferred to the medium M.

[Fuse Processing]

After the developer is transferred to the medium M in the secondary transfer processing, the medium M is continuously carried along the carrying path R1 in the direction of the arrow F1, and therefore it is input to the fuser 50.

In the fuse processing, the surface temperature of the heat application roller 51 is controlled to a predetermined temperature. When the pressure application roller 52 is rotated while being press-contacted to the heat application roller 51, the medium M is carried so as to pass between the heat application roller 51 and the pressure application roller 52.

As a result, the developer transferred to the surface of medium M is heated, and therefore the developer melts. Moreover, since the melted developer is press-contacted to the medium M, the developer firmly adheres to the medium M. Therefore, an image is formed on the surface of the medium M.

Since the medium M on which the image is formed is carried along carrying path R2 in the direction of arrow F2 by the carrying roller 73, it is sent to the stacker part 2.

Although not described here in detail, the carrying procedures of the medium M is changed according to the format of the image formed on the surface of the medium M.

For example, when images are formed on both sides of the medium M, the medium M that has passed through the fuser 50 is carried along the carrying paths R3 to R5 in the direction of the arrows F3 and F4 by the carrying rollers 64 to 67, and then along the carrying path R1 by the carrying rollers 61 and 62 again in the direction of the arrow F1. In this case, the direction in which the medium M is carried is controlled by the carrying path switching guides 71 and 72. As a result, the development processing, the primary transfer processing, the secondary transfer processing, and the fuse processing are performed again on the back side of the medium M (the face on which no image has been formed yet).

Further, for example, when an image is formed on one side of the medium M for a plurality of times, the medium M that has passed through the fuser 50 is carried along the carrying paths R3 to R5 in the direction of the arrows F3 and F4 by the carrying rollers 64 to 66, and then along the carrying path R1 by the carrying rollers 61 and 62 again in the direction of the arrow F1. In this case, the direction in which the medium M is carried is controlled by the carrying path switching guides 71 and 72. As a result, the development processing, the primary transfer processing, the secondary transfer processing, and the fuse processing are performed again on a surface (surface on which an image has been formed) of the medium M.

[Cleaning Processing]

In this image forming apparatus, the cleaning processing is performed at an arbitrary timing.

Each of the developing parts 30Y, 30M, 30C, and 30K performs cleaning processing by operating in the same manner as the developing device described above.

Further, in the transfer part 40, in the primary transfer processing, in some cases, a part of developer transferred to the surface of the intermediate transfer belt 41 is not transferred to the surface of the medium M in the secondary transfer processing, and remains on the surface of the intermediate transfer belt 41.

Therefore, in the transfer part 40, when the intermediate transfer belt 41 moves in the direction of the arrow F5, the developer remaining on the surface of the intermediate transfer belt 41 is scraped by the cleaning blade 47. As a result, unnecessary developers are removed from the surface of the intermediate transfer belt 41.

<2-3. Functions and Effects>

In this image forming apparatus, each of the developing parts 30Y, 30M, 30C, and 30K has the same configuration as the developing device described above, and therefore a high-quality image can be stably obtained. Functions and effects other than the above are the same as those described with respect to the developing device described above.

3. Modified Example

The image forming apparatus shown in FIG. 17 includes four developing parts 30 (30Y, 30M, 30C, and 30K) corresponding to four types of colors, but the number of developing parts 30 is not particularly limited. The number of developing part 30 can be arbitrarily set according to conditions such as the number of colors used for forming an image. Even in this case, the same effects can be obtained.

Further, in the image forming apparatus, each of the developing parts 30Y, 30M, 30C, and 30K has the same configuration as the developing device, but some of the developing parts 30Y, 30M, 30C, and 30K (any one type, two or three types) may have the same configuration as the developing device. Even in this case, the same effects can be obtained. However, in order to suppress the occurrence of spots, etc., in all of yellow developer image, magenta developer image, cyan developer image, and black developer image, the developing parts 30Y, 30M, 30C and 30K are preferably to have the same configuration as that of the developing device.

EXAMPLE

An example according to the present invention will be described in detail. The order of description is as follows.

1. Evaluation of physical properties of the photosensitive drum (first condition)
2. Evaluation of physical properties of the photosensitive drum (second condition)
3. Evaluation of physical properties of the cleaning blade (third condition)

<1. Evaluation of Physical Properties (First Condition) of Photosensitive Drum> Experiment Examples 1-1 to 1-22

First, in order to investigate the influence of the physical properties (first condition on scratch remaining depth) of the photosensitive drum on the image quality, an image was formed using an image forming apparatus, and the quality of the image was evaluated. The results shown in Table 1 were obtained.

In the case of forming an image, as an image forming apparatus, a modified color printer, C710dn (printing speed=45 ppm), manufactured by Oki Data Co., Ltd. was used, and as a medium for the image formation, a color printer sheet, Excellent White A4, by Oki Data Corp. was used.

A plurality of photosensitive drums (outer diameter=30 mm) with different scratch remaining depths were used as photosensitive drums. In this case, the scratch remaining depth was changed as shown in Table 1 by changing the type and composition of the forming material (polymer compound) of the photoreceptive layer. The measurement procedure of scratch remaining depth was as described above.

The dimensions of the cleaning blade (tip end portion) were set to thickness=1.5 mm to 2.0 mm, length=6.5 mm to 7.8 mm, and tolerance=f 0.15 mm. In addition, the contacted and pressed angle of the cleaning blade with respect to the photosensitive drum (the angle between the tangent of the outer circumferential surface of the photosensitive drum and the contacted and pressed direction of the tip end portion with respect to the photosensitive drum) was set to 10°, the linear pressure was set to 20 gf/cm.

As the physical properties (second condition) of the photosensitive drum other than the scratch remaining depth, the Martens hardness was set to 145 $N/mm^2$. For the physical properties (third condition) of cleaning blade, surface Young's modulus was set to 18 MPa and composition deform amount was set to 3.6 N·mm.

In order to evaluate the quality of the image, to strictly evaluate the influence of the occurrence of toner filming on the quality of the images, instead of the image formed using the image forming apparatus, the surface condition of the photosensitive drum used for the formation of the image was examined.

In this case, first, a cyan developer was used to continuously form images on 25,000 sheets of mediums. Specifically, after continuously forming images on 12,500 sheets of mediums in a normal temperature environment (temperature=25° C., humidity 50%), images were continuously formed on 12,500 sheets of mediums in an environment of low temperature and low humidity (temperature=10° C., humidity=10%). The printing condition of the image was set to printing duty=0.3% (a condition to be printed on a region corresponding to 0.3% of the printable region). The pattern of the image is printed such that a square is printed on the vicinity of the four corners of the rectangular (A4 size) medium and a heavy line extends in the longitudinal direction in the central region in the lateral direction.

Subsequently, after observing the surface of the photosensitive drum using a microscope, the toner film occupation ratio (%) was examined based on the observation result (observation image). For the microscope, a shape measurement laser microscope VK-8500 manufactured by Keyence Corporation was used, and the observation conditions were magnification=200 times, measurement mode=black and white super depth. The toner filming occupancy ratio denotes a ratio of the observation image occupied by a plurality of foreign bodies and is calculated by toner film occupation rate (%)=(total sum of areas of each foreign body/area of observation image)×100. In order to obtain this toner film occupation ratio, the area of each foreign body is calculated by distinguishing the region in which a plurality of foreign bodies exist and the other regions in the observation image using binarization processing, and after that, the sum of the areas of each foreign body was calculated.

Finally, based on the toner filming occupancy rate, the surface condition of the photosensitive drum was determined. Specifically, when the toner filming occupancy rate is less than 3%, it is judged as "A" because spots do not occur in the image since there is no foreign body on the surface of the photosensitive drum. When the toner filming occupancy rate is 3% to 4%, a small number of foreign bodies existed on the surface of the photosensitive drum, but even if a spot occurs in the image, the occurrence of the spot is at an acceptable level and hardly affects the quality, and therefore, it was judged as "B". When the toner filming occupancy rate is larger than 4%, spots which severely affect the image quality is generated by the existence of many foreign bodies on the surface of the photosensitive drum, and therefore, it was judged as "C".

TABLE 1

| Example | Scratch Remaining Depth (nm) | Filming Occupancy Ratio (%) | Judgement |
|---|---|---|---|
| 1-1 | 109 | 3.0 | B |
| 1-2 | 131 | 11.5 | C |
| 1-3 | 96 | 0.7 | A |
| 1-4 | 98 | 2.1 | A |
| 1-5 | 165 | 13.9 | C |
| 1-6 | 159 | 14.4 | C |
| 1-7 | 146 | 11.6 | C |
| 1-8 | 129 | 11.8 | C |
| 1-9 | 95 | 1.4 | A |
| 1-10 | 116 | 6.3 | C |
| 1-11 | 127 | 11.0 | C |
| 1-12 | 87 | 0.5 | A |
| 1-13 | 83 | 0.8 | A |
| 1-14 | 85 | 1.1 | A |
| 1-15 | 182 | 15.1 | C |
| 1-16 | 114 | 4.8 | C |
| 1-17 | 76 | 0.5 | A |
| 1-18 | 119 | 5.0 | C |
| 1-19 | 68 | 1.0 | A |
| 1-20 | 51 | 1.3 | A |
| 1-21 | 45 | 0.3 | A |
| 1-22 | 47 | 0.2 | A |

As shown in Table 1, the toner filming occupancy ratio varied depending on the scratch remaining depth. In this case, when the scratch remaining depth was 110 nm or less, the toner filming occupancy ratio became sufficiently small. In particular, when the scratch remaining depth was 100 nm or less, the toner filming occupancy became smaller.

<2. Evaluation of Physical Properties (Second Condition) of Photosensitive Drum> Experimental Examples 2-1 to 2-21

Next, in the case in which the physical properties (first condition regarding scratch remaining depth) of the photosensitive drum is satisfied, in order to investigate the influence of the physical properties of the photosensitive drum (second condition relating to the Martens hardness) on the quality of the image, the image was formed using the image forming apparatus, and then the quality of the image was evaluated. As a result, the results as shown in Table 2 were obtained.

In the case of forming an image, the same procedure as in Experimental Examples 1 to 4 was used, except that a plurality of photosensitive drums having different Martens hardness were used as photosensitive drums. In this case, among the photoreceptive layer having a multi-layer structure, the type and the composition of the low molecular weight compound (the compound shown in the formula (2)) included in the forming material (polyarylate resin which is a polymer compound) in the charge transportation layer was changed to change the Martens hardness as shown in Table 2. The measurement procedure of Martens hardness was as described above.

In order to evaluate the quality of the image, the occurrences of print smear due to charging failure of the photosensitive drum were checked by visually checking the state of each image while continuously forming images on 25,000 sheets of mediums, and the number of sheets of mediums (the number of printable sheets) on which the image was formed without the occurrence of the print smear was counted. Based on the number of printable sheets, the state of image formation (lifetime of the image forming apparatus) was judged. Specifically, when the printable sheet number was 25,000 sheets, since the image was normally formed on all of the mediums without the occurrence of print smear, it was judged as "A". When the number of printable sheets was 20,000 or more and less than 25,000, since the image was formed normally on most of the mediums, it was an acceptable level that would not cause a significant loss in terms of the number of used media, it was judged as "B". When the number of printable sheets was less than 20,000 sheets, since the number of mediums in which the image was not formed normally increased, and a significant loss occurred with respect to the number of used mediums, it was judged as "C".

TABLE 2

| Scratch Remaining Depth = 98 nm Filming Occupancy Ratio = 2.1% | | | |
|---|---|---|---|
| Example | Martens Hardness ($N/mm^2$) | No. of Printable Sheets | Judgement |
| 2-1 | 175 | 21000 | B |
| 2-2 | 211 | 18800 | C |
| 2-3 | 187 | 26200 | B |
| 1-4 | 145 | 38700 | A |
| 2-4 | 133 | 55400 | A |
| 2-5 | 135 | 52000 | A |
| 2-6 | 158 | 32200 | A |
| 2-7 | 156 | 32000 | A |
| 2-8 | 253 | 13700 | C |
| 2-9 | 233 | 9300 | C |
| 2-10 | 225 | 10300 | C |
| 2-11 | 233 | 9900 | C |
| 2-12 | 232 | 9800 | C |
| 2-13 | 198 | 20500 | B |
| 2-14 | 156 | 30100 | A |
| 2-15 | 177 | 26100 | B |
| 2-16 | 174 | 30200 | B |
| 2-17 | 230 | 10900 | C |
| 2-18 | 230 | 9900 | C |
| 2-19 | 195 | 20500 | B |
| 2-20 | 231 | 11100 | C |
| 2-21 | 210 | 13000 | C |

As shown in Table 2, the number of printable sheets varied according to the Martens hardness. In this case, when the Martens hardness was 100 $N/mm^2$ to 170 $N/mm^2$, a sufficient printable number of sheets was obtained.

<3. Evaluation of Physical Properties (Third Condition) of Cleaning Blade> (Experimental Examples 3-1 to 3-25)

Next, in the case where the physical properties (first condition relating to the scratch remaining depth and second condition relating to the Martens hardness) of the photosensitive drum are satisfied, the physical properties (third condition relating to the Surface Young's modulus and plastic deformation amount) on the quality of the image, an image was formed using an image forming apparatus and the quality of the image was evaluated. As a result, the results shown in Table 3 were obtained.

In the case of forming an image, the same procedure as in Experimental Examples 1 to 4 was used, except that cleaning blades (tip end portions) having different surface Young's modulus and plastic deformation amount were used. In this case, by changing the composition and the mixing ratio of the forming material of the tip end portion (polyurethane which is a polymer compound), more specifically, each type of high molecular weight polyol, low molecular weight diol and low molecular weight triol included in a curing agent, the surface Young's modulus and plastic deformation amount were changed as shown in Table 3. The measurement procedure of surface Young's modulus and plastic deformation amount was as described above.

Specifically, images were continuously formed on 30,000 sheets of mediums using a cyan developer. In this case, images were continuously formed on 12,500 sheets of mediums in a normal temperature environment (temperature=25° C., humidity=50%), then in an environment of low temperature and low humidity (temperature=10° C., humidity=10%, images were continuously formed on 17,500 sheets of mediums. The printing conditions of the image and the pattern of the image are as described above.

In order to evaluate the quality of the image, in order to strictly evaluate the influence of the occurrences of the toner filming on the image quality, the situation of scraping of the foreign body (toner filming substance) which causes toner filming was investigated. That is, instead of the image formed using the image forming apparatus, the surface state (dirty condition) of the charge roller due to the adherence of the foreign body that passed through the cleaning blade was examined.

In the case of investigating the contamination status of the charge roller, the surface of the charge roller was visually checked to judge the contamination status of the surface. Specifically, since the foreign body had hardly adhered to the surface of the charge roller, it was judged as "A" when the surface of the charge roller was not soiled. When the foreign body adhered to the surface of the charge roller and the surface of the charge roller was soiled, it was judged as "C".

TABLE 3

| Scratch Remaining Depth = 98 nm<br>Filming Occupancy Ratio = 2.1% | | | |
|---|---|---|---|
| Example | Surface Young's Modules (Mpa) | Plastic deformation Amount (N · mm) | Judgement |
| 3-1 | 10.1 | 1.8 | C |
| 3-2 | 10.2 | 3.0 | C |
| 3-3 | 10.7 | 0.5 | C |
| 3-4 | 11.3 | 0.8 | C |
| 3-5 | 15.7 | 3.0 | C |
| 3-6 | 16.4 | 2.2 | C |
| 3-7 | 17.5 | 3.8 | C |
| 1-4 | 18.0 | 3.6 | A |
| 3-8 | 18.1 | 3.9 | A |
| 3-9 | 18.2 | 1.1 | A |
| 3-10 | 18.3 | 4.6 | C |
| 3-11 | 18.7 | 2.5 | A |
| 3-12 | 19.0 | 0.6 | C |
| 3-13 | 20.3 | 3.4 | A |

TABLE 3-continued

| Scratch Remaining Depth = 98 nm<br>Filming Occupancy Ratio = 2.1% | | | |
|---|---|---|---|
| Example | Surface Young's Modules (Mpa) | Plastic deformation Amount (N · mm) | Judgement |
| 3-14 | 21.0 | 3.2 | A |
| 3-15 | 22.5 | 3.3 | A |
| 3-16 | 24.1 | 1.2 | A |
| 3-17 | 25.0 | 2.1 | A |
| 3-18 | 25.6 | 3.9 | A |
| 3-19 | 27.5 | 0.8 | C |
| 3-20 | 27.6 | 2.8 | A |
| 3-21 | 28.8 | 4.5 | C |
| 3-22 | 29.5 | 3.8 | A |
| 3-23 | 29.7 | 1.2 | A |
| 3-24 | 31.2 | 2.5 | C |
| 3-25 | 32.0 | 3.0 | C |

As shown in Table 3, the contamination status of the charge roller varied according to the surface Young's modulus and the plastic deformation amount. In this case, when the surface Young's modulus was 18 MPa to 30 MPa and the plastic deformation amount was 1 N·mm to 4 N·mm, the surface of the charge roller was almost not soiled. That is, since the surface of the photosensitive drum was sufficiently scraped by the cleaning blade, the occurrence of toner filming was suppressed.

On the other hand, when the surface Young's modulus and the plastic deformation amount did not satisfy the aforementioned conditions, the surface of the charge roller was soiled. That is, because the cleaning blade did not sufficiently scrape the surface of the photosensitive drum, toner filming occurred. In this case, mainly, the foreign body including external additives, etc., that fell off from the developer adhered entirely to the surface of charge roller or the foreign body adhered to the surface of charge roller in a ring-shape. These causes are due to the fact that the surface of the photosensitive drum is less likely to charge normally when a foreign body adheres to the surface of the charge roller, the developer unintentionally adheres to a region in which the developer should not essentially adhere to. Especially when the foreign body adheres to the surface of the charging roller in a ring shape, poor image quality such as uneven printing tends to occur.

From these reasons, high-quality images were stably obtained when the physical properties of the photosensitive drum satisfied the first condition. In this case, a higher-quality image was obtained when the physical properties of the photosensitive drum satisfied the second condition. Also, when the physical properties of the cleaning blade satisfy the third condition, a higher-quality image was obtained.

Although the present invention was described with reference to one embodiment, the present invention is not limited to the embodiment described in the aforementioned embodiment, and various variations are possible. For example, the image forming system of the image forming apparatus according to an embodiment of the present invention is not limited to an intermediate transfer system using an intermediate transfer belt, but may be another image forming system.

FIG. 18 shows test results of conventional photosensitive drums under Test Condition 1, which illustrates types of printers including these photosensitive drums, harnesses, scratch remaining depths, printable sheet numbers and filming occupancy ratio that were measured. With respect to the printing and the filming occupancy, these measured results were evaluated from Poor (C) to Good (B) to Excellent (A).

As shown in FIG. 18, it is noted that none of conventional printer (photosensitive drums) has the scratch remaining depth that is 110 nm or less where tested under such a condition. Further, in view of performance evaluation, these photosensitive drums do not meet long working span and high quality.

What is claimed is:

1. A drum unit, comprising:

a photosensitive drum, and a cleaning member that is arranged to contact to a surface of the photosensitive drum, wherein a scratch remaining depth measured by a scratch test of the photosensitive drum under a following Test Condition 1 is 110 nm or less, Test Condition 1 is:

test environment temperature=25° C.;

test environment humidity=50%;

test indenter=pre-mount type Berkovich indenter;

scratch direction=horizontal direction;

scratch speed=20 μm/sec;

initial load=0 mN;

maximum reaching load=4 mN; and load at the time of measuring the scratch remaining depth=1.9 mN.

2. The drum unit according to claim 1, wherein a Martens hardness of the photosensitive drum measured by a push-in test under a following Test Condition 2 is ranged between 100 N/mm$^2$ and 170 N/mm$^2$, Test Condition 2 is:

test environment temperature=25° C.;

test environment humidity=50%;

indenter for testing=pre-mount type Berkovich indenter;

maximum load=4 mN;

load duration=30 seconds;

peak load retention time=25 seconds; and unload duration=30 seconds.

3. The drum unit according to claim 1, wherein the cleaning member is a cleaning blade that is press-contacted to the photosensitive drum.

4. The drum unit according to claim 1, wherein the photosensitive drum includes a supporting body and a photoreceptive layer formed on the supporting body.

5. The drum unit according to claim 4, wherein the photoreceptive layer includes a charge transportation material and a charge generation material.

6. The drum unit according to claim 4, wherein the photoreceptive layer further contains a binder resin in which a charge transportation material and a charge generation material are dispersed.

7. The drum unit according to claim 4, wherein the photoreceptive layer includes a charge transportation layer that contains a binder resin in which charge transportation materials are dispersed, and a binder resin in which charge generation materials are dispersed.

8. The drum unit according to claim 3, wherein the cleaning blade includes a tip end portion that is press-contacted to the photosensitive drum and a support portion that supports the tip end portion, and a surface Young's modulus measured by a push-in test of the tip end portion under a following Test Condition 3 is ranged between 18 MPa and 30 MPa, and a plastic deformation amount measured by the push-in test of the tip end portion under the Test Condition 3 is ranged between 1 N mm and 4 N mm, and Test Condition 3 is:

test environment temperature=25° C.;

test environment humidity=50%;

indenter for testing=pre-mount type Berkovich indenter;

maximum load=5 mN;

load duration=30 seconds;

peak load retention time=25 seconds; and unload duration=30 seconds.

9. An image forming unit, comprising:

the drum unit according to claim 8; and a developer carrier that is arranged to face the photosensitive drum.

10. An image forming apparatus, comprising:

the image forming unit according to claim 9;

an exposure unit that exposes the photosensitive drum; and a transfer part that is arranged to face the photosensitive drum.

* * * * *